US009764565B2

(12) United States Patent
Nakai et al.

(10) Patent No.: US 9,764,565 B2
(45) Date of Patent: Sep. 19, 2017

(54) PRINTING APPARATUS, PRINTING SYSTEM, AND PRINTING METHOD

(71) Applicants: Junji Nakai, Kanagawa (JP); Hiroyoshi Matsumoto, Kanagawa (JP)

(72) Inventors: Junji Nakai, Kanagawa (JP); Hiroyoshi Matsumoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/977,188

(22) Filed: Dec. 21, 2015

(65) Prior Publication Data

US 2016/0229199 A1 Aug. 11, 2016

(30) Foreign Application Priority Data

Dec. 25, 2014 (JP) ..... 2014-263268
Jul. 9, 2015 (JP) ..... 2015-138171

(51) Int. Cl.
*B41J 11/00* (2006.01)

(52) U.S. Cl.
CPC ..... *B41J 11/002* (2013.01); *B41J 11/0015* (2013.01)

(58) Field of Classification Search
CPC ..... B41J 11/002; B41J 11/0015
See application file for complete search history.

(56) References Cited

U.S. PATENT DOCUMENTS 6,789,887 B2 9/2004 Yang et al.
9,120,334 B2 9/2015 Nagai et al.
2014/0078212 A1 3/2014 Nakai et al.
2014/0160197 A1 6/2014 Hirose et al.
2014/0285564 A1 9/2014 Dirubio et al.
2015/0035918 A1 2/2015 Matsumoto et al.
2015/0076124 A1 3/2015 Tsubaki et al.
2015/0077458 A1 3/2015 Osanai et al.
2015/0077492 A1 3/2015 Nemoto
2015/0077493 A1 3/2015 Saitoh
2015/0138287 A1 5/2015 Saitoh
2015/0165789 A1 6/2015 Watanabe et al.
2015/0251453 A1 9/2015 Nakai et al.
2015/0258811 A1 9/2015 Hiratsuka et al.
2015/0258813 A1 9/2015 Saitoh et al.
2015/0258814 A1 9/2015 Matsumoto et al.
2015/0258815 A1 9/2015 Tsubaki et al.
2015/0266311 A1 9/2015 Hirose et al.
2015/0266312 A1 9/2015 Yamanaka et al.
2016/0001579 A1* 1/2016 Hatanaka ..... B41J 11/0015 347/16
2016/0009107 A1 1/2016 Nakai et al.

FOREIGN PATENT DOCUMENTS

JP 2003-211650 7/2003
JP 2003-285532 10/2003
JP 2014-076658 5/2014
JP 2014-136427 7/2014

* cited by examiner

*Primary Examiner* — Justin Seo
(74) *Attorney, Agent, or Firm* — Duft Bornsen & Fettig LLP

(57) ABSTRACT

A printing apparatus includes a plasma processor, a recording unit, and a heating unit. The plasma processor performs plasma processing on a processing target matter. The recording unit discharges ink and records dots onto the processing target matter on which the plasma processing has been performed. The heating unit heats an ink discharge region of the processing target matter.

15 Claims, 26 Drawing Sheets

| | 55℃ SETTING (MEASURED VALUE: 50℃) | 65℃ SETTING (MEASURED VALUE: 55℃) |
|---|---|---|
| 6 PASSES (HEATING TIME: SHORT) | (A)  BLUR: × OBSERVED SIGNIFICANTLY | (B)  BLUR: △ LESS THAN (A) |
| 24 PASSES (HEATING TIME: LONG) | (C)  BLUR: ○ NOT OBSERVED SUBSTANTIALLY | (D)  BLUR: ○ NOT OBSERVED SUBSTANTIALLY EQUIVALENT TO (C) |

FIG.17

| | | PLASMA ENERGY [kJ/cm$^2$] | | |
|---|---|---|---|---|
| | | 0 | 3 | 40 |
| HEATING TEMPERATURE [°C] | 30 | 3 | 3 | 5 |
| | 40 | 3 | 4 | 5 |
| | 50 | 3 | 4 | 5 |
| | 60 | 3 | 4 | 5 |

FIG.18

| | | 6 PASSES | | | | 3 PASSES | | | |
|---|---|---|---|---|---|---|---|---|---|
| | | PLASMA ENERGY [kJ/cm$^2$] | | | | PLASMA ENERGY [kJ/cm$^2$] | | | |
| | | 0 | 3 | 20 | 40 | 0 | 3 | 20 | 40 |
| HEATING TEMPERATURE [°C] | 30 | 2 | 3 | 4 | 5 | 2 | 2 | 2 | 3 |
| | 40 | 2 | 3 | 4 | 5 | 2 | 2 | 4 | 4 |
| | 50 | 4 | 4 | 5 | 5 | 2 | 3 | 5 | 5 |
| | 60 | 5 | 5 | 5 | 5 | 2 | 5 | 5 | 5 |

FIG.19

| | | 6 PASSES | | | | 3 PASSES | | | |
|---|---|---|---|---|---|---|---|---|---|
| | | PLASMA ENERGY [kJ/cm$^2$] | | | | PLASMA ENERGY [kJ/cm$^2$] | | | |
| | | 0 | 3 | 20 | 40 | 0 | 3 | 20 | 40 |
| HEATING TEMPERATURE [°C] | 30 | 3 | 3 | 4 | 5 | 2 | 2 | 3 | 4 |
| | 40 | 3 | 3 | 4 | 5 | 2 | 3 | 4 | 5 |
| | 50 | 4 | 4 | 5 | 5 | 2 | 3 | 5 | 5 |
| | 60 | 5 | 5 | 5 | 5 | 3 | 5 | 5 | 5 |

| HEATING CONDITIONS | | PLASMA ENERGY [kJ/m$^2$] | | |
|---|---|---|---|---|
| AIR VELOCITY [m/s] | HOT AIR TEMPERATURE °C | 0 | 3 | 40 |
| 1 | 30 | 3 | 3 | 5 |
| | 40 | 3 | 4 | 5 |
| | 50 | 3 | 4 | 5 |
| 3 | 30 | 3 | 4 | 5 |
| | 40 | 3 | 4 | 5 |
| | 50 | 3 | 4 | 5 |
| 5 | 30 | 3 | 4 | 5 |
| | 40 | 3 | 4 | 5 |
| | 50 | 4 | 4 | 5 |

FIG.31

| | | 6 PASSES | | | | 3 PASSES | | | |
|---|---|---|---|---|---|---|---|---|---|
| HEATING CONDITIONS | | PLASMA ENERGY [kJ/m$^2$] | | | | PLASMA ENERGY [kJ/m$^2$] | | | |
| AIR VELOCITY [m/s] | HOT AIR TEMPERA-TURE °C | 0 | 3 | 20 | 40 | 0 | 3 | 20 | 40 |
| 1 | 30 | 2 | 3 | 4 | 5 | 2 | 2 | 2 | 4 |
| | 40 | 4 | 4 | 4 | 5 | 2 | 2 | 3 | 5 |
| | 50 | 5 | 5 | 5 | 5 | 2 | 2 | 3 | 5 |
| 3 | 30 | 2 | 3 | 4 | 5 | 2 | 2 | 3 | 4 |
| | 40 | 4 | 4 | 5 | 5 | 2 | 2 | 3 | 5 |
| | 50 | 5 | 5 | 5 | 5 | 2 | 2 | 4 | 5 |
| 5 | 30 | 3 | 4 | 5 | 5 | 2 | 2 | 3 | 5 |
| | 40 | 4 | 4 | 5 | 5 | 2 | 3 | 4 | 5 |
| | 50 | 5 | 5 | 5 | 5 | 2 | 3 | 4 | 5 |

FIG.32

| | | 6 PASSES | | | | 3 PASSES | | | |
|---|---|---|---|---|---|---|---|---|---|
| HEATING CONDITIONS | | PLASMA ENERGY [kJ/m$^2$] | | | | PLASMA ENERGY [kJ/m$^2$] | | | |
| AIR VELOCITY [m/s] | HOT AIR TEMPERA-TURE °C | 0 | 3 | 20 | 40 | 0 | 3 | 20 | 40 |
| 1 | 30 | 3 | 3 | 4 | 5 | 2 | 2 | 3 | 4 |
| | 40 | 4 | 4 | 5 | 5 | 2 | 2 | 3 | 5 |
| | 50 | 5 | 5 | 5 | 5 | 3 | 3 | 4 | 5 |
| 3 | 30 | 3 | 4 | 5 | 5 | 2 | 2 | 3 | 5 |
| | 40 | 4 | 4 | 5 | 5 | 2 | 2 | 4 | 5 |
| | 50 | 5 | 5 | 5 | 5 | 3 | 3 | 4 | 5 |
| 5 | 30 | 3 | 4 | 5 | 5 | 2 | 2 | 4 | 5 |
| | 40 | 4 | 5 | 5 | 5 | 2 | 3 | 4 | 5 |
| | 50 | 5 | 5 | 5 | 5 | 3 | 4 | 4 | 5 |

FIG.33A
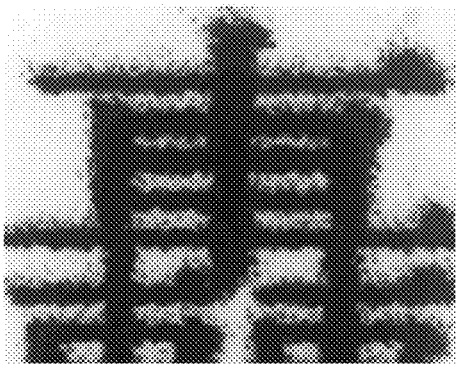
FIG.33B
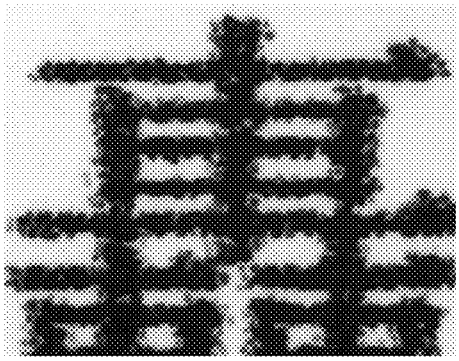
FIG.34
| | | GAP 1.8 [mm] | | | | GAP 2.8 [mm] | | | |
|---|---|---|---|---|---|---|---|---|---|
| HEATING CONDITIONS | | PLASMA ENERGY [kJ/m$^2$] | | | | PLASMA ENERGY [kJ/m$^2$] | | | |
| AIR VELOCITY [m/s] | HOT AIR TEMPERA-TURE °C | 0 | 3 | 20 | 40 | 0 | 3 | 20 | 40 |
| 1 | 30 | 5 | 5 | 5 | 5 | 4 | 5 | 5 | 5 |
| | 40 | 5 | 5 | 5 | 5 | 4 | 4 | 4 | 5 |
| | 50 | 5 | 5 | 5 | 5 | 4 | 4 | 4 | 4 |
| 3 | 30 | 4 | 4 | 4 | 4 | 3 | 3 | 4 | 5 |
| | 40 | 4 | 4 | 4 | 4 | 3 | 3 | 4 | 4 |
| | 50 | 4 | 4 | 4 | 4 | 2 | 2 | 4 | 4 |
| 5 | 30 | 3 | 3 | 3 | 3 | 2 | 2 | 3 | 4 |
| | 40 | 3 | 3 | 3 | 3 | 2 | 2 | 3 | 4 |
| | 50 | 3 | 3 | 3 | 3 | 3 | 3 | 4 | 4 |

PRINTING APPARATUS, PRINTING SYSTEM, AND PRINTING METHOD

CROSS-REFERENCE TO RELATED APPLICATIONS

The present application claims priority to and incorporates by reference the entire contents of Japanese Patent Application No. 2014-263268 filed in Japan on Dec. 25, 2014 and Japanese Patent Application No. 2015-138171 filed in Japan on Jul. 9, 2015.

BACKGROUND OF THE INVENTION

1. Field of the Invention

The present invention relates to a printing apparatus, a printing system, and a printing method.

2. Description of the Related Art

Printing methods of recording an image by discharging ink have been known. A technique of improving image quality of an image with recorded dots has been disclosed (for example, Japanese Laid-open Patent Publication No. 2003-285532). Japanese Laid-open Patent Publication No. 2003-285532 discloses that a recording medium is heated to a temperature higher than that of discharged ink.

Image quality of an image recorded with dots is, however, deteriorated in some cases with the above-mentioned conventional technique.

SUMMARY OF THE INVENTION

It is an object of the present invention to at least partially solve the problems in the conventional technology.

According to exemplary embodiments of the present invention, there is provided a printing apparatus comprising: a plasma processor that performs plasma processing on a processing target matter; a recording unit that discharges ink and records dots onto the processing target matter on which the plasma processing has been performed; and a heating unit that heats an ink discharge region of the processing target matter.

Exemplary embodiments of the present invention also provide a printing system comprising: a plasma processing device that performs plasma processing on a processing target matter, and a printing apparatus including a recording unit that discharges ink and records dots onto the processing target matter on which the plasma processing has been performed and a heating unit that heats an ink discharge region of the processing target matter.

Exemplary embodiments of the present invention also provide a printing method that is executed by a printing apparatus including a plasma processor that performs plasma processing on a processing target matter, a recording unit that discharges ink and records dots onto the processing target matter on which the plasma processing has been performed, and a heating unit that heats an ink discharge region of the processing target matter, the printing method comprising: controlling at least one of plasma energy by the plasma processor and heating energy by the heating unit so that predetermined dots are recorded on the processing target matter.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 17 is a view illustrating evaluation results of robustness;

FIG. 18 is a view illustrating evaluation results of bleeding;

FIG. 19 is a view illustrating evaluation results of beading;

FIG. 31 is a view illustrating evaluation results of bleeding;

FIG. 32 is a view illustrating evaluation results of beading;

FIGS. 33A and 33B are views illustrating an example of an evaluation result;

FIG. 34 is a view illustrating evaluation results of image quality;

DETAILED DESCRIPTION OF THE PREFERRED EMBODIMENTS

Figure 1:
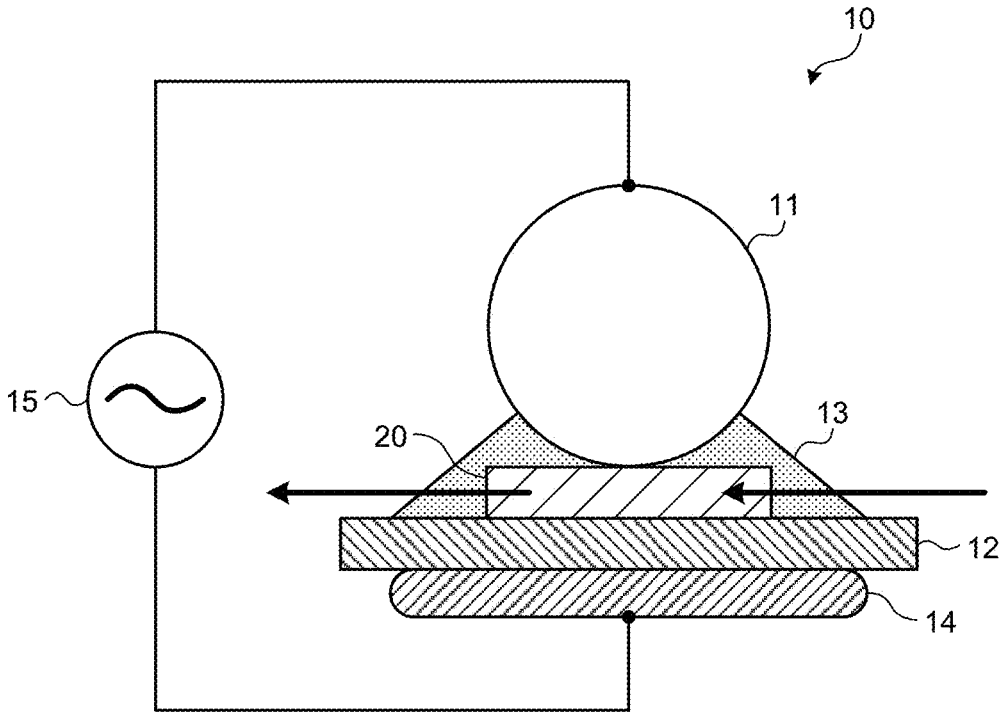
FIG. 1 is a descriptive view for explaining plasma processing according to an embodiment of the present invention.

The following describes embodiments of a printing apparatus, a printing system, and a printing method in detail with reference to the accompanying drawings.

First Embodiment

A printing apparatus in the present embodiment includes a plasma processor. The plasma processor performs plasma processing on a processing target matter.

Examples of the processing target matter that is used in a first embodiment include a recording medium having impermeability, a recording medium having slow-permeability, and a recording medium having permeability.

The recording medium having impermeability indicates a recording medium through which liquid droplets of ink or other materials do not permeate substantially. The expression "do not permeate substantially" means that the permeability of the liquid droplets after one minute is equal to or lower than 5%. Examples of the recording medium having impermeability include art paper, synthetic resin film or sheet, rubber film or sheet, coated paper, glass film or sheet, metal film or sheet, ceramic film or sheet, and wood film or sheet. Furthermore, a composite base material formed by combining two or more of these materials described above in order to add functions can also be used. A medium configured by forming a layer having impermeability (for example, coated layer) on plain paper or other materials may be also used.

The recording medium having slow-permeability indicates a recording medium through which the total amount of liquid permeates in equal to or more than 100 msec when liquid droplets of 10 picoliter (pl) are made to drop onto the recording medium. A specific example of the recording medium having slow-permeability includes the art paper. The recording medium having permeability indicates a recording medium through which the total amount of liquid permeates in less than 100 msec when liquid droplets of 10 pl are made to drop onto the recording medium. Specific examples of the recording medium having permeability include plain paper and porous paper.

The printing apparatus in the present embodiment is particularly effective when the recording medium having impermeability or the recording medium having slow-permeability is applied as the processing target matter.

Hereinafter, the processing target matter is referred to as a recording medium in some cases.

The printing apparatus in the present embodiment performs the plasma processing on the processing target matter. To be specific, the printing apparatus in the present embodiment performs the plasma processing on the surface of the processing target matter.

When the plasma processing is performed on the surface of the processing target matter, wettability of the surface of the processing target matter is improved. The improvement in the wettability of the surface of the processing target matter causes dots that have landed on the processing target matter on which the plasma processing has been performed to spread rapidly. Ink on the surface of the processing target matter can be therefore dried rapidly. Accordingly, ink pigment aggregates while being prevented from being dispersed. As a result, generation of beading, bleeding, and the like can be suppressed. The beading is a phenomenon that adjacent dots attract each other so as to be united. The bleeding indicates blur between different colors.

To be specific, in the plasma processing, an organic matter of the surface is oxidized with reactive species such as oxygen radical, hydroxyl radical (—OH), and ozone generated in plasma and hydrophilic functional groups are formed.

The usage of the plasma processing can not only control wettability (hydrophilicity) of the surface of the processing target matter but also control a pH value of the surface of the processing target matter (acidize the surface of the processing target matter). Furthermore, the usage of the plasma processing can control aggregation performance of the pigment contained in an ink layer formed on the processing target matter on which the plasma processing has been performed.

In addition, the usage of the plasma processing can improve roundness of dots with the ink (hereinafter, referred to as dots simply) by controlling the permeability and can enlarge sharpness and color gamut of the dots while preventing unification of the dots. As a result, a printed matter on which an image with high quality has been formed can be provided while eliminating image failures such as the beading and the bleeding. An amount of the ink that is discharged (hereinafter, referred to as an ink amount in some cases) can be reduced by making the aggregation thickness of the pigment on the processing target matter thin and uniform so as to reduce ink dry energy and printing cost.

FIG. 1 is a descriptive view for explaining an outline of the plasma processing that is employed in the present embodiment. As illustrated in FIG. 1, a plasma processing device 10 including a discharge electrode 11, a counter electrode 14, a dielectric material 12, and a high-frequency high-voltage power supply 15 is used for the plasma processing that is employed in the present embodiment. The dielectric material 12 is arranged between the discharge electrode 11 and the counter electrode 14. The high-frequency high-voltage power supply 15 applies a high-frequency high-voltage pulse voltage to between the discharge electrode 11 and the counter electrode 14.

A voltage value of the pulse voltage is approximately 10 kilovolt (kV) (p-p), for example. A frequency thereof is approximately 20 kilohertz (kHz), for example. Atmospheric-pressure non-equilibrium plasma 13 is generated between the discharge electrode 11 and the dielectric material 12 by supplying the high-frequency high-voltage pulse voltage to between the two electrodes. A processing target matter 20 passes through between the discharge electrode 11 and the dielectric material 12 while the atmospheric-pressure non-equilibrium plasma 13 is generated. With the passage, the plasma processing is performed on the processing target matter 20 at the discharge electrode 11 side (that is, surface of the processing target matter 20 at the processing target surface side).

FIG. 1 illustrates the case where the plasma processing device 10 employs the discharge electrode 11 of a rotary type and the dielectric material 12 of a conveyer belt type, as an example. The processing target matter 20 is held and conveyed between the rotating discharge electrode 11 and the dielectric material 12 so as to pass through the atmospheric-pressure non-equilibrium plasma 13. With this passage, the processing target surface of the processing target matter 20 makes contact with the atmospheric-pressure non-equilibrium plasma 13 and is subjected to the plasma processing. The atmospheric-pressure non-equilibrium plasma 13 is plasma using dielectric barrier discharge.

The plasma processing with the atmospheric-pressure non-equilibrium plasma 13 is one preferable method as a plasma processing method on the processing target matter 20 because an electronic temperature is extremely high and a gas temperature is around a normal temperature.

In order to generate the atmospheric-pressure non-equilibrium plasma 13 in a wide range stably, it is preferable that atmospheric-pressure non-equilibrium plasma processing employing the dielectric barrier discharge of a streamer insulation breakdown type be executed. The dielectric barrier discharge of the streamer insulation breakdown type can be executed by applying an alternating high voltage to between electrodes coated with a dielectric material, for example.

Various methods other than the dielectric barrier discharge of the streamer insulation breakdown type can be used as the method of generating the atmospheric-pressure non-equilibrium plasma 13. For example, dielectric barrier discharge involving insertion of an insulating material such as a dielectric material into between the electrodes, corona discharge involving formation of a significant non-uniform electric field on a thin metal wire or other objects, and pulse discharge involving application of a short-pulse voltage can be applied. Furthermore, equal to or more than two of the above-mentioned methods can also be combined. The plasma processing in the present embodiment is executed in the air but is not limited thereto and may be executed under a gas atmosphere of nitrogen, oxygen, or the like.

The plasma processing device 10 as illustrated in FIG. 1 employs the discharge electrode 11 that is rotatable so as to feed the processing target matter 20 in the conveyance direction of the processing target matter 20. The configuration of the plasma processing device 10 is not, however, limited to this configuration. As will be described later, equal to or more than one discharge electrode(s) movable in the direction (scanning direction) perpendicular to the conveyance direction of the processing target matter 20 may be employed, for example.

Next, the plasma processing that is used in the present embodiment will be described more in detail.

In the plasma processing, the processing target matter 20 is irradiated with plasma in the air. This plasma irradiation causes polymer in the surface of the processing target matter 20 to make reaction so as to form hydrophilic functional groups. To be specific, electrons discharged from the discharge electrode are accelerated in an electric field so as to excite and ionize atoms and molecules in the air. Electrons are also discharged from the ionized atoms and molecules and electrons with high energy are increased, resulting in generation of streamer discharge (plasma).

The electrons with high energy from the streamer discharge cleave polymer binding in the surface of the processing target matter 20 (for example, coated paper) and recombination with the oxygen radical O*, the hydroxyl radical (—OH), and ozone $O_3$ in a gas phase is made. It should be noted that a coat layer of the coated paper is solidified by calcium carbonate and starch as a binder and the starch has a polymer structure.

With this, polar functional groups such as a hydroxyl group and a carboxyl group are formed on the surface of the processing target matter 20. As a result, hydrophilicity and acidity are added to the surface of the processing target matter 20. The wettability of the surface of the processing target matter 20 is therefore improved and the surface of the processing target matter 20 is acidified (the pH value thereof lowers).

The acidification in the present embodiment means that the pH value of the surface of the processing target matter 20 is lowered to a pH value at which the pigment contained in the ink aggregates. The lowering of the pH value causes a concentration of hydrogen ions $H^+$ in a substance to be increased. The pigment in the ink before making contact with the surface of the processing target matter 20 is charged negatively and is dispersed in a vehicle.

Figure 2:
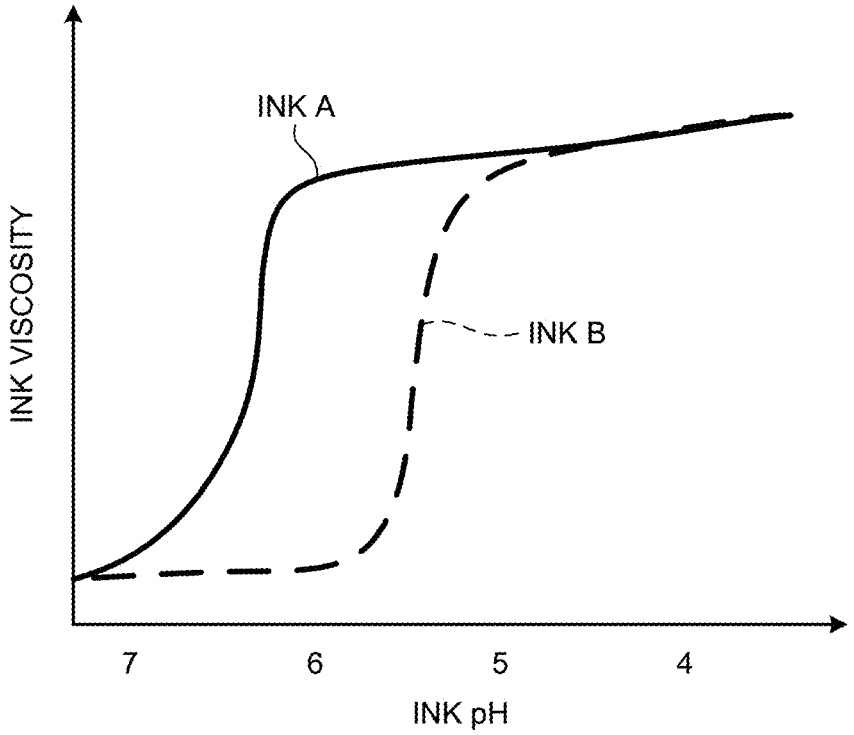
FIG. 2 is a graph illustrating an example of relations between an ink pH value and ink viscosity.

FIG. 2 is a graph illustrating an example of relations between an ink pH value and ink viscosity. As illustrated in FIG. 2, the viscosity of the ink is increased as the pH value thereof is lower for the following reason. That is, as the acidity of the ink is higher, the pigment charged negatively in the vehicle of the ink is neutralized electrically and pigment particles aggregate with one another, as a result.

Accordingly, the viscosity of the ink can be increased by lowering the pH value of the surface of the processing target matter 20 such that the pH value of the ink is a value corresponding to desired viscosity in the graph as illustrated in FIG. 2, for example. This is because when the ink adheres to the surface of the processing target matter 20, the pigment is neutralized electrically with the hydrogen ions $H^+$ of the surface and the pigment particles aggregate with one another. Accordingly, color mixture between adjacent dots can be prevented and the pigment can be prevented from permeating the processing target matter 20 deeply (to the rear surface thereof). It should be noted that the pH value of the surface of the processing target matter 20 is required to be lower than the pH value of the ink corresponding to the desired viscosity.

Furthermore, the pH value in order to provide the desired viscosity of the ink depends on characteristics of the ink. Pigment particles in ink A in FIG. 2 aggregate with one another and the viscosity thereof is increased at a pH value relatively close to neutrality. In contrast, a pH value of ink B is required to be lower than that of the ink A in order to make pigment particles therein aggregate with one another.

Aggregation behavior of the pigment in the dots, dry speed of the vehicle, and permeation speed through the processing target matter 20 are different depending on amounts of the ink (for example, small droplets, middle droplets, large droplets) varying with a dot size, types of the processing target matter 20, types of the ink, and other conditions. In consideration of the dependency, the printing apparatus in the present embodiment may control a plasma energy amount in the plasma processing to an appropriate value in accordance with the type of the processing target matter 20, the amount of the ink that is discharged, the type of the ink, and other conditions.

The amount of the ink that is used in control may be an amount of the ink that is discharged per unit area of the processing target matter 20 or an amount of the ink that is used for recording one dot. In the present embodiment, a case will be described where the amount of the ink that is used in control is the amount of the ink that is used for recording one dot, as an example.

Figure 3:
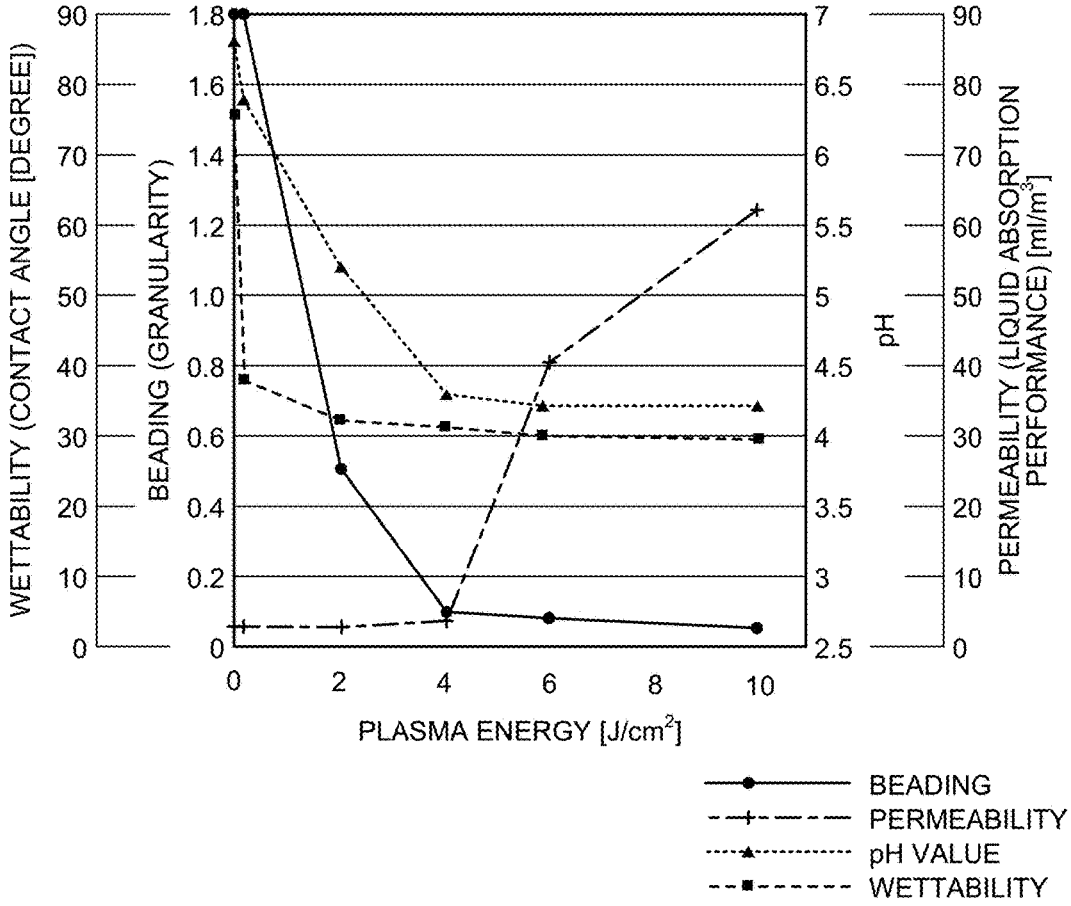
FIG. 3 is a graph illustrating evaluation results.

FIG. 3 is a graph illustrating evaluation results of the plasma energy, the wettability of the surface of the processing target matter 20, the breading, the pH value, and the permeability in the present embodiment. FIG. 3 illustrates variation manners of the surface characteristics (the wettability, the beading, the pH value, and the permeability (liquid absorption performance)) depending on the plasma energy when printing is performed on the coated paper as the processing target matter 20. Aqueous pigment ink (alkaline ink containing dispersed pigment charged negatively) having a characteristic that the pigment aggregated with acid was used to provide the evaluations as illustrated in FIG. 3.

As illustrated in FIG. 3, the wettability of the surface of the coated paper became drastically preferable when the plasma energy was a low value (for example, equal to or lower than approximately 0.2 J/cm$^2$) and was not so improved even by further increasing the energy. The pH value of the surface of the coated paper was lowered to some extent by increasing the plasma energy. When the plasma energy exceeded a certain value (for example, approximately 4 J/cm$^2$), the lowering of the pH value was made into a saturation state. The permeability (liquid absorption performance) became drastically preferable from around the time when the lowering of the pH value was saturated (for example, approximately 4 J/cm$^2$). This phenomenon is considered to occur depending on polymer components contained in the ink.

As a result, it has been found that a value of the beading (granularity) is extremely preferable when the permeability (liquid absorption performance) becomes preferable (for example, approximately 4 J/cm$^2$). The beading (granularity) herein indicates surface roughness of an image that is expressed by a numerical value and indicates variation in density that is expressed by a standard deviation of average density.

In FIG. 3, the standard deviation of a plurality of sampled densities of a color solid image formed by dots of equal to or more than two colors is expressed as the beading (granularity). It has been thus found that the ink discharged onto the coated paper on which the plasma processing in the present embodiment has been performed permeates the coated paper while spreading in a complete round manner and aggregating.

The improvement in the wettability of the surface of the processing target matter 20 and the acidification of the surface of the processing target matter 20 (lowering of the pH value) induce aggregation of the ink pigment, improvement in permeability, permeation of the vehicle through the coated paper, for example. These phenomena cause the pigment density on the surface of the processing target matter 20 to be increased so as to suppress movement of the pigment even when the dots are unitized. Accordingly, turbidity of the pigment can be suppressed, whereby settling and aggregating the pigment on the surface of the processing target matter 20 can be performed uniformly.

Furthermore, the improvement in the wettability of the surface of the processing target matter 20 and the acidification (lowering of the pH value) of the surface of the processing target matter 20 increase the aggregation rate of the pigment contained in the ink and adjust irregularities (surface roughness) of the surface of the ink layer with the ink.

Figure 4:
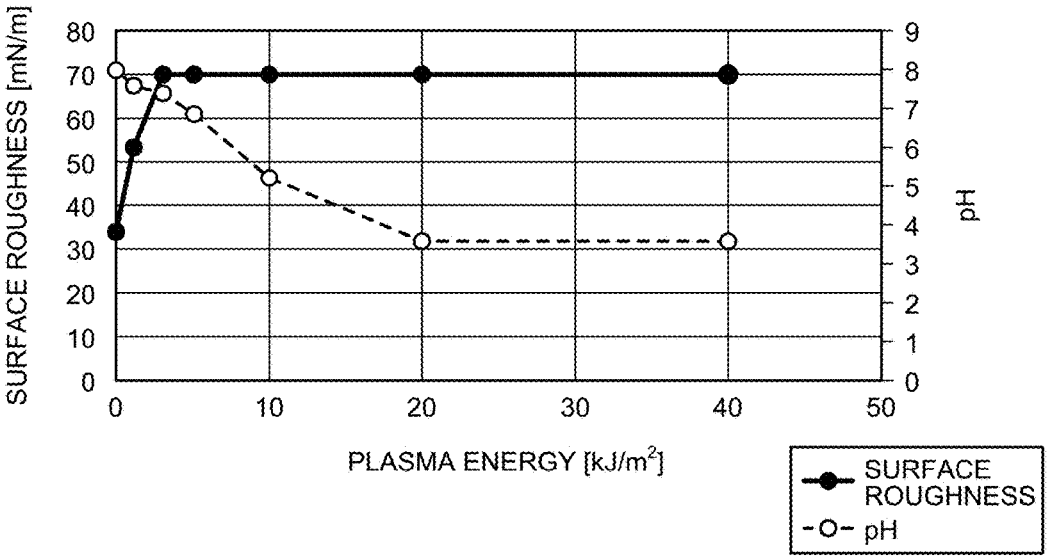
FIG. 4 is a graph illustrating a relation among plasma energy, surface roughness, and a pH value.
Figure 5:
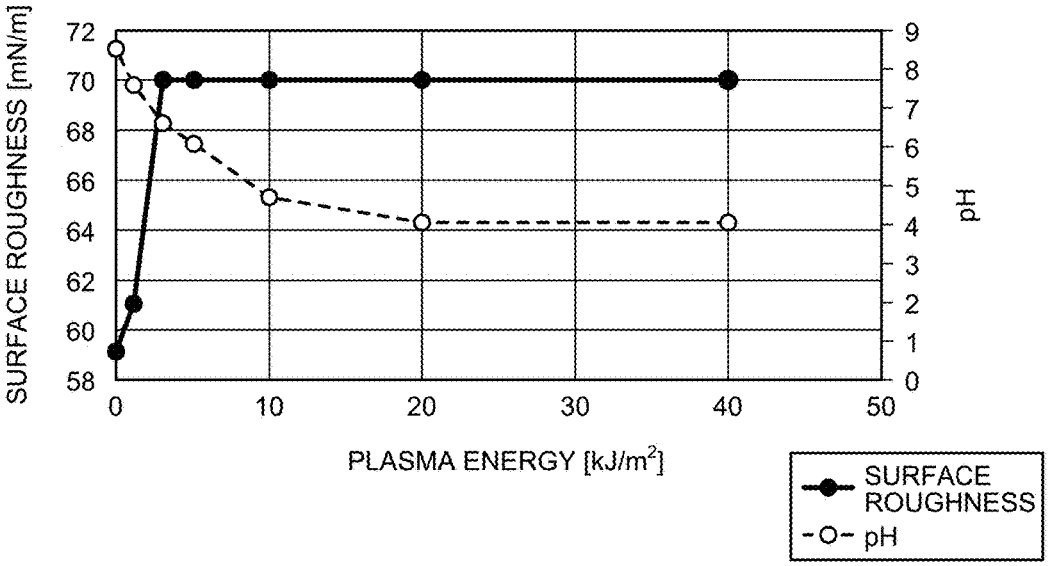
FIG. 5 is a graph illustrating a relation among the plasma energy, the surface roughness, and the pH value.

FIG. 4 and FIG. 5 illustrate a relation among the plasma energy, the surface roughness, and the pH value. The surface roughness is surface roughness of the surface of the ink layer with the ink that is formed on the processing target matter 20 on which the plasma processing has been performed. The pH value is a pH value of the surface of the processing target matter 20 on which the plasma processing has been performed. FIG. 4 illustrates the relation provided by using a vinyl chloride sheet as the processing target matter 20. FIG. 5 illustrates the relation provided by using a PET film as the processing target matter 20.

As illustrated in FIG. 4 and FIG. 5, as the plasma energy was larger, the pH value lowered and the surface roughness of the ink layer increased. When the plasma energy was increased, the surface roughness was increased and the increase was saturated at equal to or larger than certain plasma energy.

It has been thus found that the irregularities (surface roughness) of the surface of the ink layer with the ink and the pH value can be adjusted by adjusting the plasma energy of the plasma processing.

An adjustment effect of the surface roughness is different depending on components of the ink (types of the ink) or the ink amounts. For example, when the ink that is discharged is in small droplets, turbidity of the pigment due to unification of dots is more difficult to occur than the case of large droplets. This is because the vehicle is dried and permeates more rapidly when a vehicle is in small droplets. That is to say, in such a case, the pigment can be made to aggregate with moderate pH reaction. An effect of the plasma processing varies depending on the types of the processing target matter 20 as illustrated in FIG. 4 and FIG. 5. In consideration of this dependency, the plasma energy in the plasma processing may be controlled to an appropriate value in accordance with the ink amount, the type of the processing target matter 20, and the components of the ink (that is, the ink type).

Figure 6:
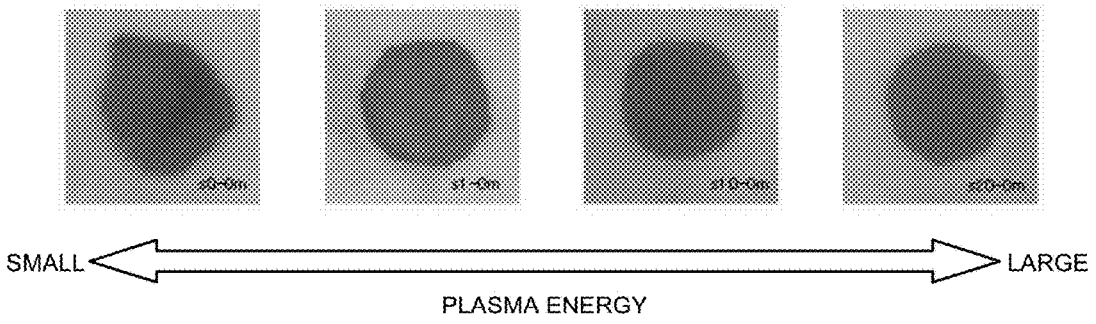
FIG. 6 is a view illustrating observation results of the plasma energy and uniformity of pigment aggregation.

FIG. 6 is a view illustrating observation results of the plasma energy and uniformity of the pigment aggregation. As illustrated in FIG. 6, it has been found that as the plasma energy is larger, the uniformity of the pigment aggregation is improved. In addition, it has been found that roundness of the dot can be adjusted in accordance with the plasma energy. The shape of the dot, the diameter of the dot, and the density distribution in the dot can be therefore adjusted in accordance with the plasma energy.

Figure 7:
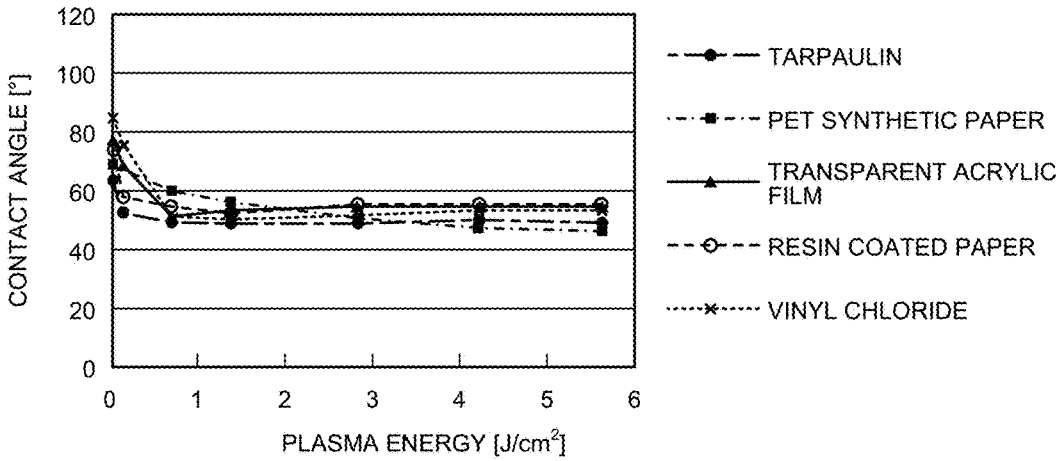
FIG. 7 is a graph illustrating measurement results of contact angles of pure water.

FIG. 7 is a graph illustrating measurement results of contact angles of pure water when the plasma processing was performed on impermeable recording media of various types. In FIG. 7, the transverse axis indicates the plasma energy. As illustrated in FIG. 7, it has been found that the wettability of even an impermeable recording medium is increased by performing the plasma processing thereon. This is because the aqueous pigment ink is easier to wet the recording medium because surface tension thereof is lower than that of pure water. That is to say, the aqueous pigment ink becomes easy to spread thinly in a wetting manner by the plasma processing, which results in a surface state that is advantageous for evaporation of water. Furthermore, the effect of the plasma processing was also observed when the impermeable recording medium formed by thermal plastic resin such as vinyl chloride, polyester, and acryl was used.

Figure 8:
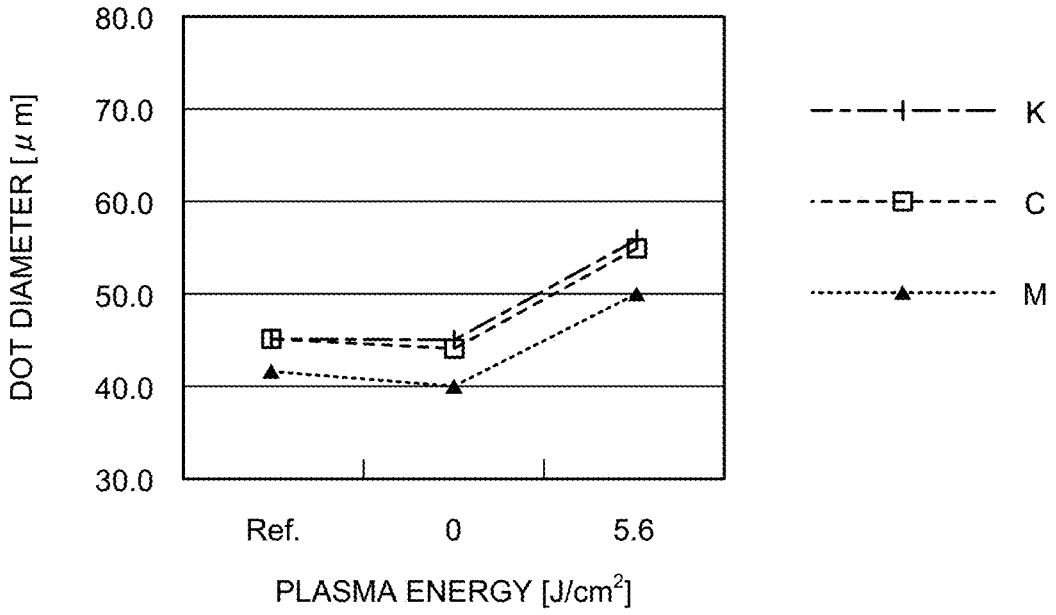
FIG. 8 is a graph illustrating dot diameters.
Figure 9:
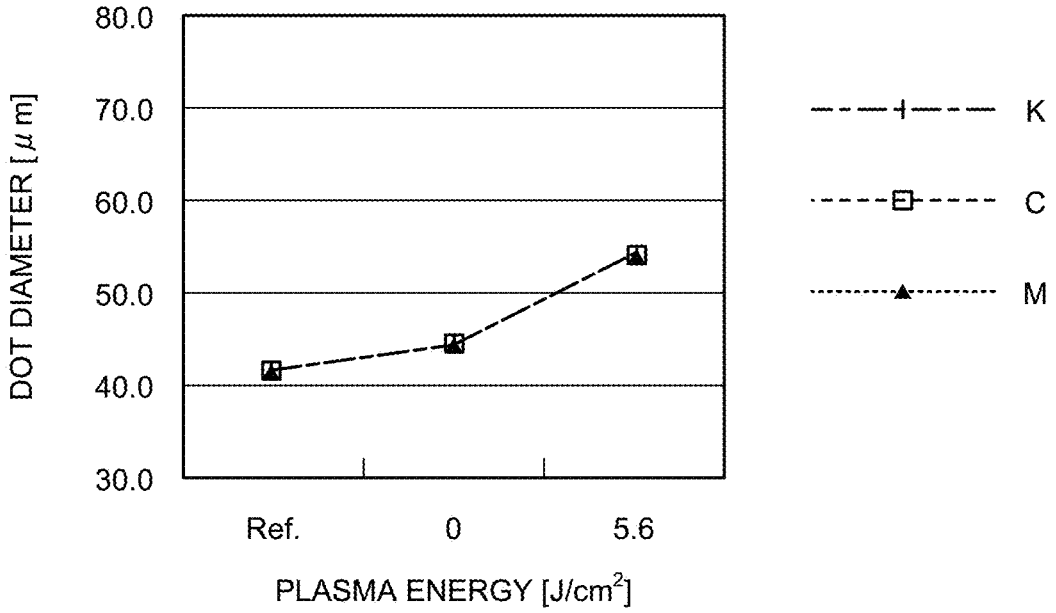
FIG. 9 is a graph illustrating the dot diameters.

FIG. 8 is a graph illustrating diameters of dots (hereinafter, also referred to as dot diameter in some cases) when ink droplets having the same size were made to drop on the surface of a vinyl chloride sheet as the impermeable recording medium. FIG. 9 is graph illustrating the dot diameters when the ink droplets having the same size were made to drop on a tarpaulin surface as the impermeable recording medium. The tarpaulin is a sheet produced by interposing a polyester-based fiber between synthetic resins.

Aqueous pigment inks of black (K) ink, cyan (C) ink, and magenta (M) ink were used for the inks in experiments of FIG. 8 and FIG. 9 which were prepared to have the surface tension of 21 to 24 N/m and the viscosity of 8 to 11 mPa·s by adding and dispersing the pigment of approximately 3 wt % and styrene-acrylic resin of approximately 5 wt % that has a particle diameter of 100 to 300 nm into a mixture of ether-based and diol-based solvents of approximately 50 wt % and a small amount of surfactant.

As illustrated in FIG. 8 and FIG. 9, when the plasma processing was performed (5.6 J/cm$^2$), the dot diameter was increased by 1.2 to 1.3 times those when the plasma processing was not performed (Ref.) and when the plasma processing was not performed and the number of heaters used for drying the ink was reduced (0 J/cm$^2$). This result means that as described above, when the plasma processing is performed (5.6 J/cm$^2$), the ink landed on the surface of the impermeable recording medium can be dried rapidly.

Figure 10:
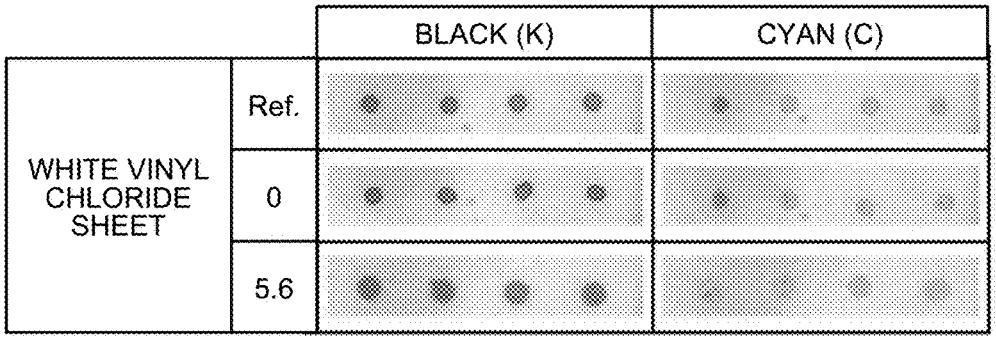
FIG. 10 is an image illustrating dots.

FIG. 10 is an image illustrating dots actually formed on the surface of the impermeable recording medium (vinyl chloride sheet) when ink droplets having the same size were made to drop on the surface of the recording medium. FIG. 10 illustrates ink dots of black ink on a left column and ink dots of cyan ink on a right column. In FIG. 10, dot formation was performed four times under each of conditions. As illustrated in FIG. 10, when the plasma processing was performed (5.6 J/cm$^2$), the dot diameters were larger than those when the plasma processing was not performed (Ref.) and when the plasma processing was not performed and the number of heaters used for drying the ink was reduced (0 J/cm$^2$). In addition, when the plasma processing was performed (5.6 J/cm$^2$), roundness of the dots was improved in comparison with those when the plasma processing was not performed (Ref.) and when the plasma processing was not performed and the number of heaters used for drying the ink was reduced (0 J/cm$^2$).

Figure 11:
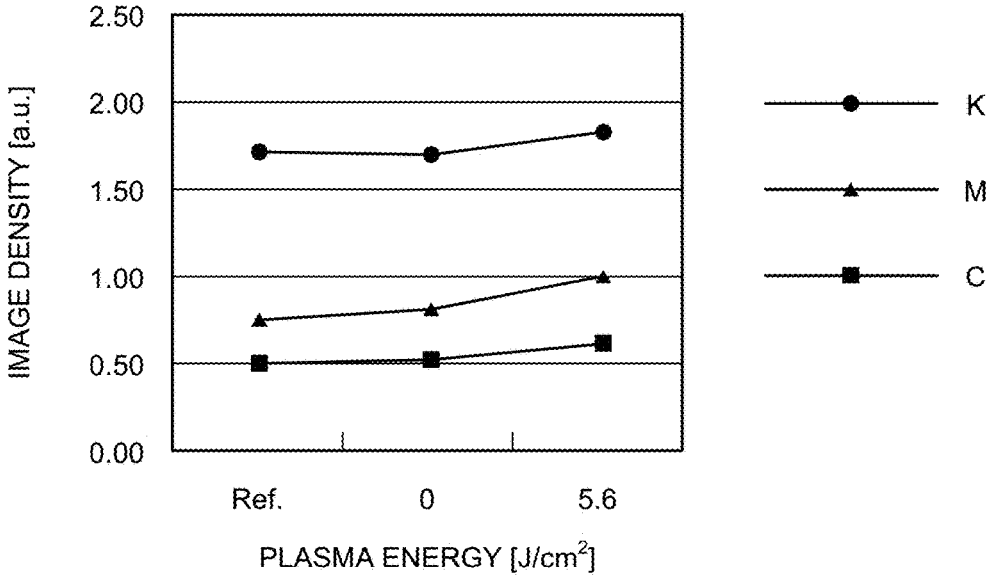
FIG. 11 is a graph illustrating image densities.
Figure 12:
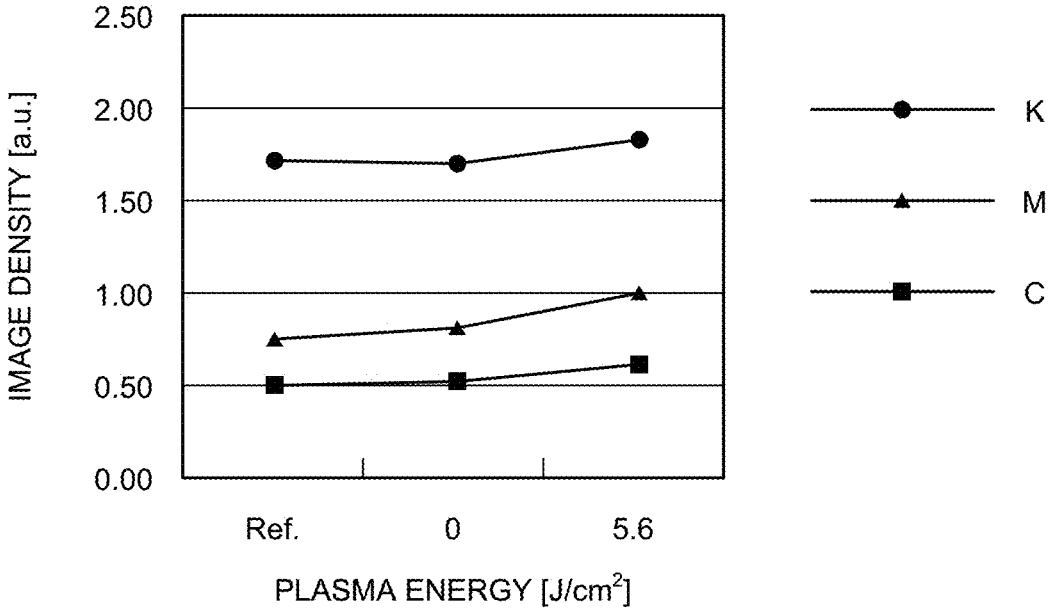
FIG. 12 is a graph illustrating the image densities.

FIG. 11 is a graph illustrating image densities provided by solid printing on the vinyl chloride sheet as the impermeable recording medium under respective conditions. FIG. 12 is a graph illustrating image densities provided by solid printing on the tarpaulin as the impermeable recording medium under respective conditions. As illustrated in FIG. 11 and FIG. 12, when the plasma processing was performed (5.6 J/cm$^2$), the image densities became higher than those when the plasma processing was not performed (Ref.) and when the plasma processing was not performed and the number of heaters used for drying the ink was reduced (0 J/cm$^2$). These results indicate that even when the ink amount is reduced, the same density as that when the ink amount is large and the plasma processing is not performed can be provided by performing the plasma processing.

The printing apparatus in the present embodiment further includes a heating unit. That is to say, the printing apparatus in the present embodiment includes the plasma processor and the heating unit.

The heating unit heats an ink discharge region of the processing target matter 20.

That is to say, the printing apparatus in the present embodiment performs the plasma processing on the processing target matter 20 and heats the ink discharge region of the processing target matter 20.

The ink discharge region in the present embodiment indicates both of an ink discharge target region and a region on which the ink has been discharged on the processing target matter 20. That is to say, the ink discharge target region of the processing target matter 20 corresponds to the ink discharge region at timing before the dots with the ink are recorded or at timing at which the dots with the ink are recorded. The region on which the ink has been discharged corresponds to the ink discharge region at timing after the dots with the ink are recorded.

Figure 13:
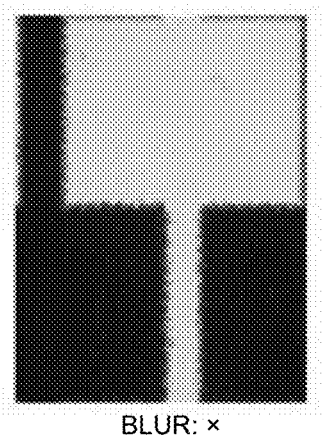
FIG. 13 is a view illustrating evaluation results of image blur.
Figure 13:
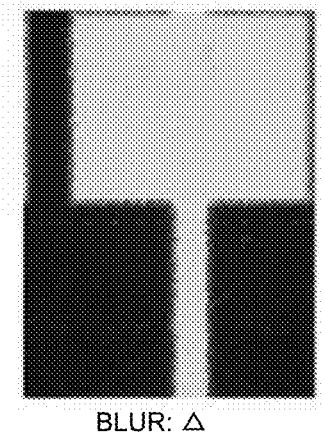
Figure 13:
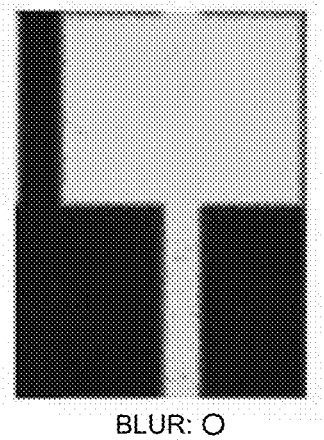
Figure 13:
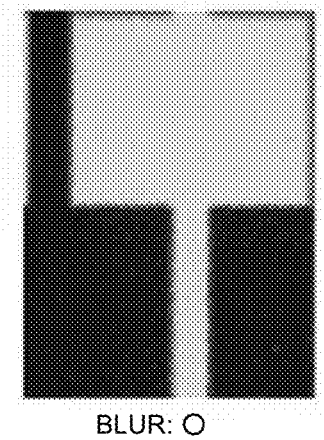

FIG. 13 is a view illustrating evaluation results of image blur. In the evaluation results as illustrated in FIG. 13, the heating unit was provided at a position capable of heating the processing target matter 20 at the time of the recording of the dots with the ink as a heating condition. Under this heating condition, the heating unit was provided on a multi-pass recording head and heating time was adjusted by the number of passes (referred to as the number of scans in some cases). When a heating temperature by the heating unit (that is, a heat generation temperature by the heating unit) was set to 55° C., a measured value of the surface temperature of the heated processing target matter 20 was 50° C. When the heating temperature by the heating unit was set to 65° C., a measured value of the surface temperature of the heated processing target matter 20 was 55° C. The multi-pass recording head recorded the dots with the ink by the number of passes corresponding to the heating time.

As illustrated at a section (A) in FIG. 13, when the heating temperature by the heating unit was set to 55° C. and the heating time was short, blur was significantly observed. In the evaluation results as illustrated in FIG. 13, short heating time corresponds to a period of time during which the multi-pass recording head is moved by 6 passes (that is, 6 scans). In the evaluation results as illustrated in FIG. 13, long heating time corresponds to a period of time during which the multi-pass recording head is moved by 24 passes (that is, 24 scans).

As illustrated at a section (B) in FIG. 13, when the heating temperature by the heating unit was set to 65° C. and the heating time was short, blur was observed although being less significant than that at the section (A) in FIG. 13. As illustrated at a section (C) in FIG. 13, when the heating temperature by the heating unit was set to 55° C. and the heating time was long, blur was not substantially observed. As illustrated at a section (D) in FIG. 13, when the heating temperature by the heating unit was set to 65° C. and the heating time was long, blur was not substantially observed.

From the evaluation results as illustrated in FIG. 13, it has been found that deterioration of image quality can be reduced by adjusting heating energy defined by the heating temperature and the heating time.

Simple heating of the processing target matter 20 causes the quality of an image that is recorded with the dots to be deteriorated in some cases when the printing speed is increased.

Figure 14A:
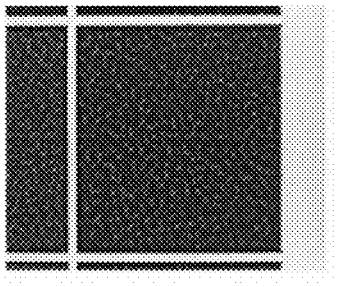
FIGS. 14A to 14C are views illustrating evaluation results of image beading.
Figure 14B:
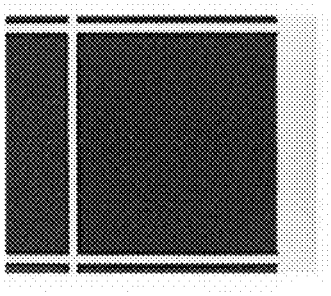
Figure 14C:
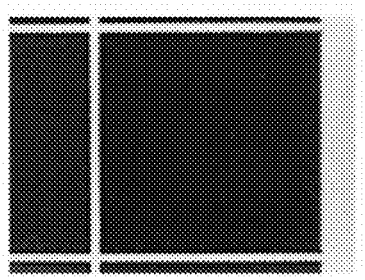

FIGS. 14A to 14C are views illustrating evaluation results of image beading. The heating conditions in FIGS. 14A to 14C were the same as those in FIG. 13 except that the heating time was changed. In FIGS. 14A to 14C, the heating time was set to each of a period of time during which the multi-pass recording head was moved by 3 passes and a period of time during which the multi-pass recording head was moved by 6 passes.

To be specific, FIG. 14A is a view illustrating the evaluation result of an image formed when the heating temperature by the heating unit was set to 65° C. and the heating time was set to the period of time for 3 passes (that is, 3 scans). FIG. 14B is a view illustrating the evaluation result of an image formed when the heating temperature by the heating unit was set to 65° C. and the heating time was set to the period of time for 6 passes.

As illustrated in FIG. 14A and FIG. 14B, in order to improve the printing speed, the conveyance speed is required to be improved and the number of passes (the number of scans) performed by the recording head is therefore required to be smaller. As illustrated in FIG. 14A, the beading was generated in the recording by 3 passes. In contrast, the beading was suppressed in the recording by 6 passes even at the same heating temperature (see FIG. 14B). Thus, when the printing speed was increased (to 3 passes from 6 passes), image quality was deteriorated even when the heating was performed.

After the plasma processing was performed on the processing target matter 20, recording of the dots with the ink and heating under the heating conditions (heating temperature and heating time) same as those in FIG. 14A were performed. As a result, as illustrated in FIG. 14C, the beading was suppressed even in the recording by 3 passes in comparison with that in FIG. 14A.

Figure 15A:
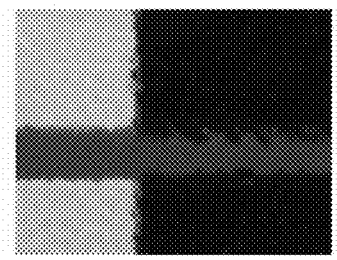
FIGS. 15A to 15C are views illustrating evaluation results of image bleeding.
Figure 15B:
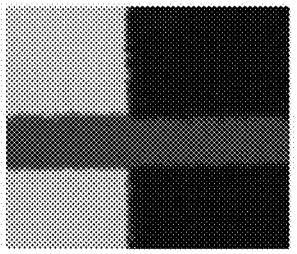
Figure 15C:
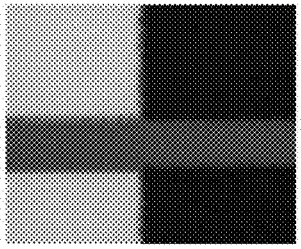

FIGS. 15A to 15C are views illustrating evaluation results of image bleeding. The heating conditions and presence or absence of the plasma processing in FIGS. 15A to 15C were the same as those in FIGS. 14A to 14C, respectively.

To be specific, FIG. 15A is a view illustrating the evaluation result of an image formed when the heating temperature by the heating unit was set to 65° C. and the heating time was set to the period of time for 3 passes (that is, 3 scans). FIG. 15B is a view illustrating the evaluation result of an image formed when the heating temperature by the heating unit was set to 65° C. and the heating time was set to the period of time for 6 passes. FIG. 15C is a view illustrating the evaluation result of when recording of the dots with the ink and the heating performed by the heating unit (heating temperature: 65° C., heating time: the period of time for 3 passes) were performed after the plasma processing was performed.

As illustrated in FIG. 15A, the bleeding was generated in the recording by 3 passes even by heating at 65° C. The bleeding was suppressed in the recording by 6 passes even at the same heating temperature although the printing speed was lower than that in the case of the recording by 3 passes (see FIG. 15B).

As illustrated in FIG. 15C, bleeding was suppressed even in the recording by 3 passes when the plasma processing, the recording of the dots by discharge of the ink (3 passes), and the heating of the processing target matter 20 (for a period of time corresponding to 3 passes) were performed.

Figure 16:
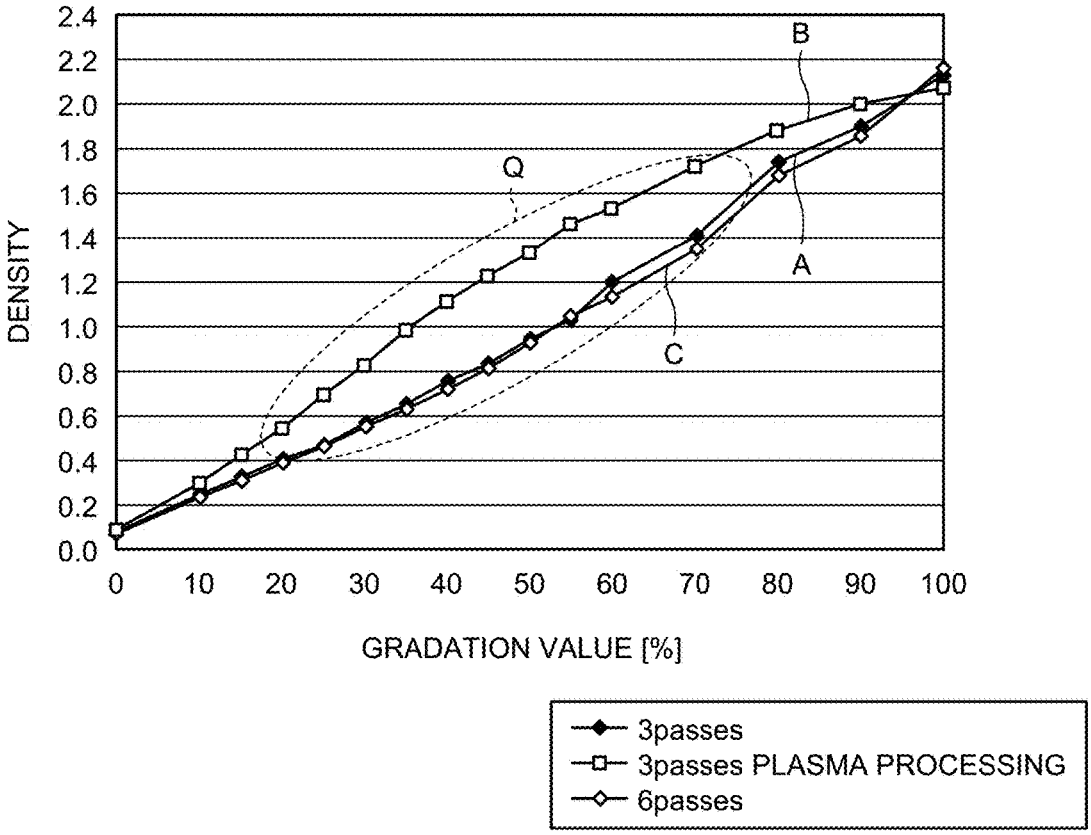
FIG. 16 is a graph illustrating relations between a gradation value and the image density.

FIG. 16 is a graph illustrating relations between a gradation value (also referred to as a pixel value in some cases) indicated by image data and a density of an image formed based on the image data. FIG. 16 illustrates, by a line A, the relation between the gradation value and the density of an image recorded by 3 passes when the heating temperature by the heating unit was set to 65° C. and the heating time was set to the period of time for 3 passes. FIG. 16 illustrates, by a line C, the relation between the gradation value and the density of an image recorded by 6 passes when the heating temperature by the heating unit was set to 65° C. and the heating time was set to the period of time for 6 passes. FIG. 16 illustrates, by a line B, the relation between the gradation value and the density of an image when the heating temperature by the heating unit was set to 65° C., the heating time was set to the period of time for 3 passes, and the recording by 3 passes, the plasma processing before recording, and the heating were performed.

As illustrated in FIG. 16, as for dots formed based on the image data having the same gradation value, the image density of when the plasma processing and the heating were combined was improved.

In particular, on a region of a half-tone gradation portion (graduation value of 20% to 70%) (see, a region Q in FIG. 16), the image density of when the plasma processing and the heating were combined was improved (see, the line B) rather than those of when the heating was simply performed (see, the line A and the line C). This is because the roundness of the dots was improved by performing the plasma processing even when the amount of the ink discharged onto the processing target matter 20 was the same. Furthermore, the evaluation results as illustrated in FIG. 16 indicate that in the case where the dots are formed based on the image data having the same gradation value, even when the printing speed is increased, deterioration in image quality can be reduced by combining the heating and the plasma processing in comparison with the case of the simple heating. It can also be said that the combination of the heating and the plasma processing can reduce a necessary amount of ink.

FIG. 17 is a view illustrating evaluation results of robustness. FIG. 17 illustrates the evaluation results of the robustness of an image with recorded dots corresponding to the plasma energy by the plasma processing and the heating temperature. It should be noted that the plasma processing was performed before the dot recording by discharge of the ink. The heating time was set to be constant and only the heating temperature was adjusted. The heating timing of the processing target matter 20 was set to a time point at which the dots were recorded with the ink.

A larger value of the evaluation result of the robustness illustrated in FIG. 17 indicates higher robustness. To be specific, the robustness is normal when the value is "3" and the robustness is preferable when the value is "5".

As illustrated in FIG. 17, as at least one of the plasma energy and the heating temperature was higher, the robustness was more preferable. As both of the plasma energy and the heating temperature were higher, the robustness was more preferable.

This is because, although depending on the types of the processing target matter 20, higher plasma energy indicates larger irregularities on the surface of the ink layer (roughened), increased acidification, and a higher aggregation rate of the pigment. As the heating temperature is higher, the aggregation rate of the pigment is increased. In addition, as both of the plasma energy and the heating temperature are higher, the ink is dried in a state where the roughness of the ink layer is increased with high plasma energy.

FIG. 18 is a view illustrating evaluation results of bleeding. FIG. 18 illustrates the evaluation results of the bleeding of an image with recorded dots corresponding to the plasma energy by the plasma processing and the heating temperature.

FIG. 18 illustrates the evaluation results of the bleeding that corresponds to the heating temperature and the plasma energy for each of the case where recording of moving the multi-pass recording head by 6 passes (that is, 6 scans) was performed and the heating time was set to the period of time for 6 passes and the case where recording of moving the multi-pass recording head by 3 passes was performed and the heating time was set to the period of time for 3 passes. The heating timing of the processing target matter 20 was set to a time point at which the dots were recorded with the ink.

A larger value of the evaluation result of bleeding illustrated in FIG. 18 indicates a more preferable evaluation result. To be specific, the evaluation result is not preferable when the value is equal to or lower than "2" and the evaluation result is preferable when the value is "5".

As illustrated in FIG. 18, as at least one of the plasma energy and the heating temperature was higher, the evaluation result of bleeding was more preferable. As both of the plasma energy and the heating temperature were higher, the evaluation result of bleeding was more preferable. It has been found that even in the recording by 3 passes with the high printing speed, the value "5" indicating a preferable evaluation result of bleeding can be provided by adjusting the heating temperature and the plasma energy as in the recording by 6 passes with the low printing speed.

FIG. 19 is a view illustrating evaluation results of beading. FIG. 19 illustrates the evaluation results of the beading of an image with recorded dots corresponding to the plasma energy by the plasma processing and the heating temperature.

FIG. 19 illustrates the evaluation results of the beading that corresponds to the heating temperature and the plasma energy for each of the case where recording of moving the multi-pass recording head by 6 passes (that is, 6 scans) was performed and the heating time was set to the period of time for 6 passes and the case where recording of moving the multi-pass recording head by 3 passes was performed and the heating time was set to the period of time for 3 passes. The heating timing of the processing target matter 20 was set to a time point at which the dots were recorded with the ink.

A larger value of the evaluation result of beading illustrated in FIG. 19 indicates a more preferable evaluation result. To be specific, the evaluation result is not preferable when the value is equal to or lower than "2" and the evaluation result is preferable when the value is "5".

As illustrated in FIG. 19, as at least one of the plasma energy and the heating temperature was higher, the evaluation result of beading was more preferable. As both of the plasma energy and the heating temperature were higher, the evaluation result of beading was more preferable. It has been found that even in the recording by 3 passes with the high printing speed, the value "5" indicating a preferable evaluation result of beading can be provided by adjusting the heating temperature and the plasma energy as in the recording by 6 passes with the low printing speed.

The inventors of the present invention have found that deterioration in image quality can be reduced by combining the plasma processing on the processing target matter 20 and the heating of the ink discharge region of the processing target matter 20 from the above-mentioned evaluation results. Furthermore, the inventors have found that this combined configuration can reduce the deterioration in image quality even when the printing speed is increased.

The inventors have found that predetermined target dots satisfying at least one of a predetermined diameter, a predetermined shape, and a predetermined density distribution (aggregation degree of the pigment) can be recorded by adjusting the plasma energy of the plasma processing on the processing target matter 20 and the heating energy.

The inventors have found that the plasma energy and the heating energy necessary for recording the predetermined target dots are different depending on the types of the processing target matter 20, the amounts of the ink, the types of the ink, and printing modes.

The printing mode indicates printing speed. The printing speed indicates resolution of an image that is recorded, specifically. As the printing speed is higher, the resolution of the image that is recorded is lower. As the printing speed is lower, the resolution of the image that is recorded is higher. To be more specific, when dots are recorded using the multi-pass recording head, as the number of passes (scans) is larger, the resolution is higher and the printing speed is lower. As the number of passes (scans) is smaller, the resolution is lower and the printing speed is higher. The printing mode indicates at least one of the printing speed, the resolution, and the number of passes.

The printing apparatus in the present embodiment includes the plasma processor, the heating unit, and the recording unit. The printing apparatus in the present embodiment further includes a controller, and controls at least one of the plasma energy by the plasma processor and the heating energy by the heating unit such that the predetermined dots are recorded on the processing target matter 20.

The printing apparatus in the present embodiment controls at least one of the plasma energy by the plasma processor and the heating energy by the heating unit in accordance with at least one of the type of the processing target matter 20, the ink amount, the ink type, and the printing mode.

Next, the printing system including the printing apparatus in the present embodiment will be described in detail.

Figure 20A:
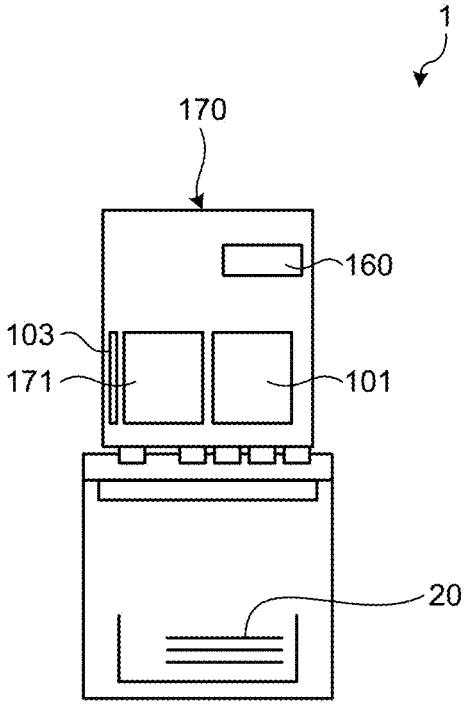
FIGS. 20A and 20B are plan views illustrating the schematic configuration of a printing system.
Figure 20B:
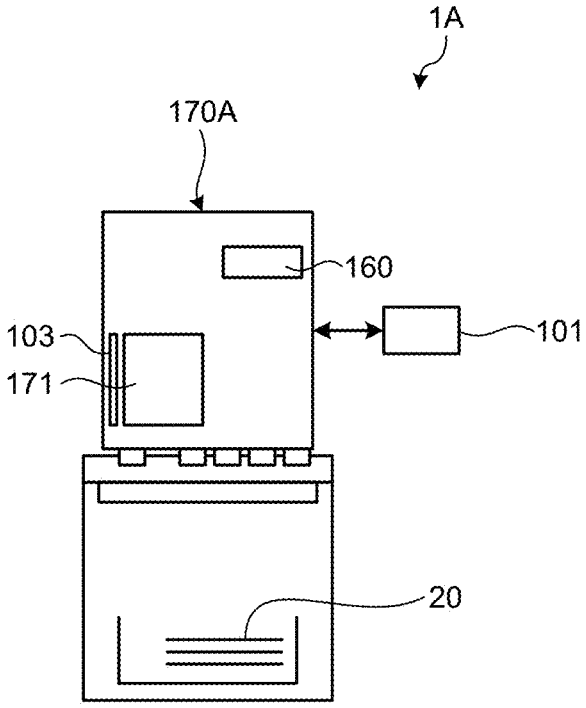

FIGS. 20A and 20B are plan views illustrating the schematic configuration of the printing system in the present embodiment. As illustrated in FIG. 20A, a printing system 1 includes a printing apparatus 170. The printing apparatus 170 includes a recording unit 171, a plasma processor 101, a heating unit 103, and a controller 160.

The plasma processor 101 performs the plasma processing on the processing target matter 20. The recording unit 171 discharges ink and records dots onto the processing target matter 20 on which the plasma processing has been performed. The heating unit 103 heats the ink discharge region of the processing target matter 20. The printing apparatus 170 performs the plasma processing, records the dots with the ink, and heats the processing target matter 20 while sequentially conveying the processing target matter 20.

In the present embodiment, a case will be described where the printing apparatus 170 includes the plasma processor 101. The printing apparatus 170 and the plasma processor 101 may be configured as separate bodies, alternatively. In this case, as illustrated in FIG. 20B, it is sufficient that a printing system 1A includes a printing apparatus 170A and the plasma processor 101. The printing apparatus 170A is the same as the printing apparatus 170 except that the plasma processor 101 is not included.

Next, the schematic configuration of the printing apparatus 170 will be described with reference to FIG. 21 to FIG. 23 selectively.

In the present embodiment, a case will be described where a multi-pass system is employed as an inkjet recording system of the printing apparatus 170, as an example.

Figure 21:
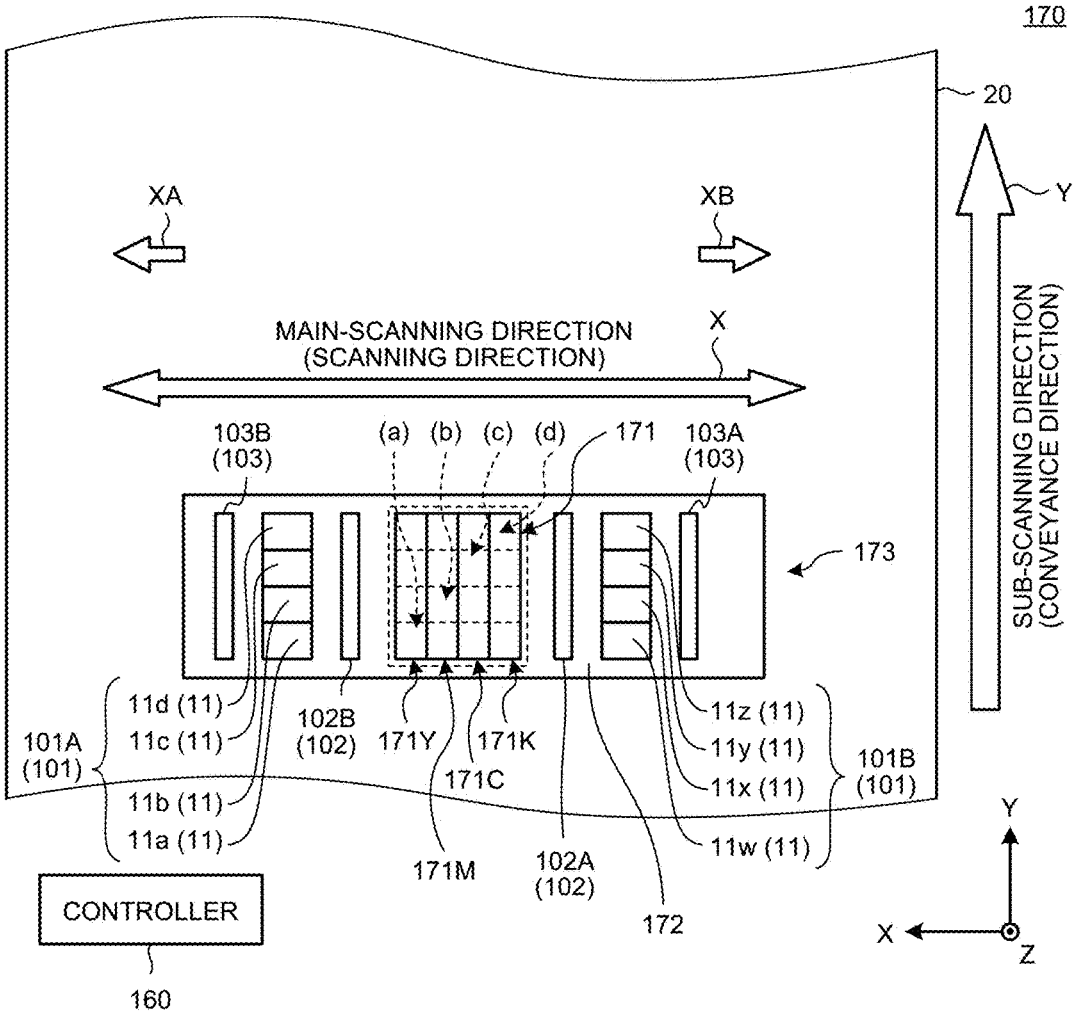
FIG. 21 is a top view illustrating the schematic configuration of a head unit.

FIG. 21 is a top view illustrating the schematic configuration of a head unit 173 of the printing apparatus 170. FIG. 22 is a side view illustrating the schematic configuration of the head unit 173 along the scanning direction (main-scanning direction, direction of an arrow X). FIG. 23 is a plan view illustrating the schematic configuration of the plasma processor 101 mounted on the head unit 173.

Figure 22:
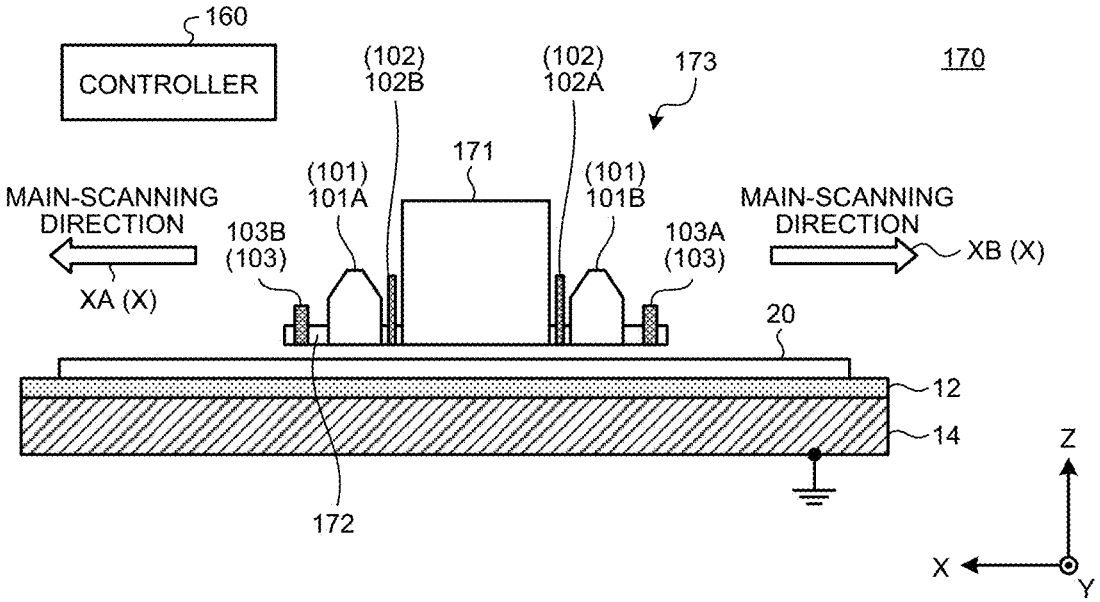
FIG. 22 is a side view illustrating the schematic configuration of the head unit.

As illustrated in FIG. 21 and FIG. 22, the printing apparatus 170 includes the controller 160, the recording unit 171, and the plasma processor 101. The printing apparatus 170 includes the heating unit 103 and a detector 102. The detector 102, the heating unit 103, the recording unit 171, and the plasma processor 101 are electrically connected to the controller 160.

The plasma processor 101, the detector 102, the heating unit 103, and the recording unit 171 are mounted on a carriage 172 that is made to scan in the main-scanning direction (direction of the arrow X in FIG. 21 and FIG. 22). The head unit 173 includes the plasma processor 101, the detector 102, the heating unit 103, and the recording unit 171, and supports them.

The carriage 172 causes the head unit 173 to reciprocate in the direction (referred to as the scanning direction or the main-scanning direction (see, direction of the arrow X)) orthogonal to the conveyance direction (sub-scanning direction, direction of an arrow Y) of the processing target matter 20 by a driving mechanism (not illustrated). The recording unit 171 records dots on the processing target matter 20 by discharging ink droplets while being conveyed in the scanning direction by the carriage 172.

The plasma processor 101 performs the plasma processing on the processing target matter 20. The plasma processor 101 has the same configuration as that of the plasma processing device 10 as illustrated in FIG. 1.

Figure 23:
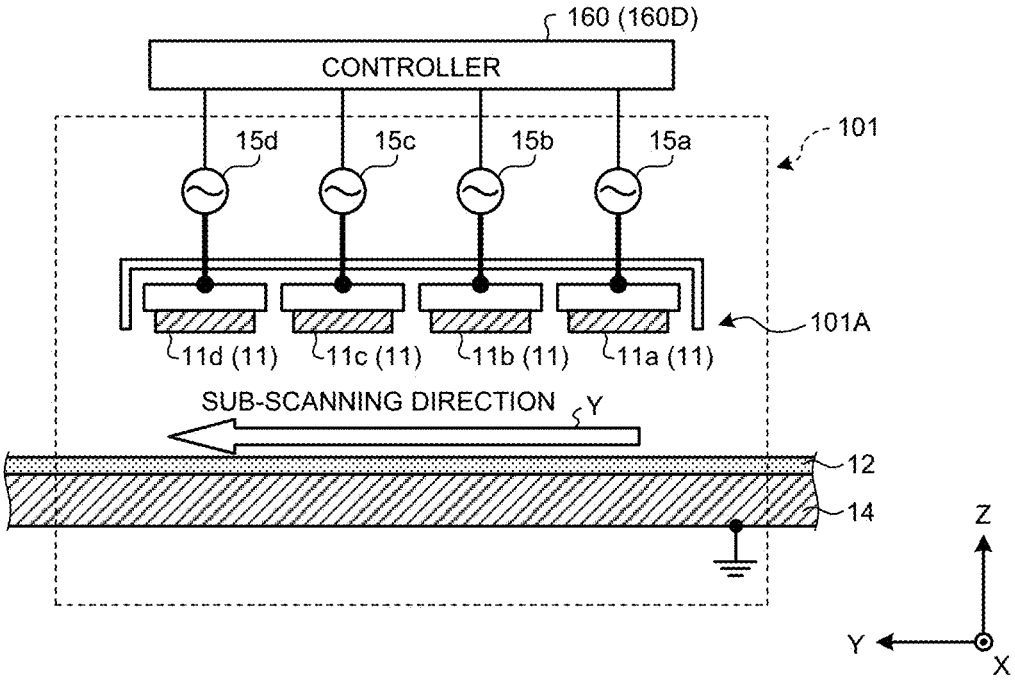
FIG. 23 is a plan view illustrating the schematic configuration of a plasma processor.

In the example as illustrated in FIG. 21 to FIG. 23, the plasma processor 101 includes a plurality of discharge electrodes 11*a* to 11*d* and 11*w* to 11*z*. The discharge electrodes 11*a* to 11*d* and 11*w* to 11*z* perform the plasma processing on the surface of the processing target matter 20 (the surface of the processing target matter 20 that opposes the plasma processor 101) by discharging electricity while being conveyed in the scanning direction by the carriage 172.

The recording unit 171 discharges the ink and records the dots onto the processing target matter 20 on which the plasma processor 101 has performed the plasma processing.

For example, the recording unit 171 includes a plurality of discharge heads (for example, four colors×four heads). In the present embodiment, a case will be described where the recording unit 171 includes discharge heads (171Y, 171M, 171C, and 171K) of four colors of black (K), cyan (C), magenta (M), and yellow (Y). The discharge heads are not, however, limited thereto. That is to say, the recording unit 171 may further include discharge heads corresponding to white (W), green (G), red (R) and other colors or may include only the discharge head of black (K). In the following description, K, C, M, and Y correspond to black, cyan, magenta, and yellow, respectively.

The type of the ink that is discharged by the recording unit 171 is not limited. For example, dispersion of pigment (for example, approximately 3 wt %), a small amount of surfactant, styrene-acrylic resin (having a particle diameter of 100 nm to 300 nm, for example) (for example, approximately 5 wt %), and various additives (preservative, fungicide, pH adjuster, dye dissolution auxiliary agent, antioxidant, conductivity adjuster, surface tension adjuster, oxygen absorber, and the like) in an organic solvent (for example, ether-based and diol-based solvents) (for example, approximately 50 wt %) is used as the ink.

Instead of the styrene-acrylic resin, hydrophobic resin such as acryl-based resin, vinyl acetate-based resin, styrene-butadiene-based resin, vinyl chloride-based resin, butadiene-based resin, and styrene-based resin may be used. It should be noted that any resin has a relatively low molecular weight and forms emulsion preferably.

Furthermore, glycol is preferably added to the ink as a component that effectively prevents nozzle clogging. Examples of the glycol to be added include ethylene glycol, diethylene glycol, triethylene glycol, propylene glycol, dipropylene glycol, tripropylene glycol, polyethylene glycol having a molecular weight of equal to or lower than 600, 1,3-propylene glycol, isopropylene glycol, isobutylene glycol, 1,4-butanediol, 1,3-butanediol, 1,5-pentanediol, 1,6-hexanediol, glycerin, meso-erythritol, and penta-erythritol. Other examples thereof include single bodies and mixtures of other thiodiglycols, 1,4-butanediol, 1,5-pentanediol, 1,6-hexanediol, propylene glycol, dipropylene glycol, tripropylene glycol, neopentyl glycol, 2-methyl-2,4-pentanediol, trimethylolpropane, and trimethylolethane.

Preferable examples of the organic solvent include 1 to 4-carbon alkyl alcohols such as ethanol, methanol, butanol, propanol, and isopropanol (2-propanol); glycol ethers such as ethylene glycol monomethyl ether, ethylene glycol monoethyl ether, ethylene glycol monobutyl ether, ethylene glycol monomethyl ether acetate, diethylene glycol monomethyl ether, diethylene glycol monoethyl ether, diethylene glycol mono-n-propyl ether, ethylene glycol mono-iso-propyl ether, diethylene glycol mono-iso-propyl ether, ethylene glycol mono-n-butyl ether, ethylene glycol mono-t-butyl ether, diethylene glycol mono-t-butyl ether, 1-methyl-1-methoxybutanol, propylene glycol monomethyl ether, propylene glycol monoethyl ether, propylene glycol mono-t-butyl ether, propylene glycol mono-n-propyl ether, propylene glycol mono-iso-propyl ether, dipropylene glycol monomethyl ether, dipropylene glycol monoethyl ether, dipropylene glycol mono-n-propyl ether, and dipropylene glycol mono-iso-propyl ether; formamide; acetamide; dimethyl sulfoxide; sorbitol; sorbitan; acetin; diacetin; triacetin; sulfolane; pyrrolidone; and N-methyl pyrrolidone.

A main component of the ink may be water. When the organic solvent, monomer, and oligomer are not used for the ink, an ink cartridge and a supply path formed by special members are not required to be selected, thereby simplifying the apparatus configuration.

The ink type is defined by a mixture ratio of these materials contained in the ink and types of contained components.

In the present embodiment, a case will be described where the printing apparatus 170 uses cut paper provided by cutting into a predetermined size (for example, A4 paper size and B4 paper size) as the processing target matter 20. The processing target matter 20 that is used by the printing apparatus 170 is not, however, limited thereto and may be continuous paper (also referred to as roll paper in some cases).

Although the type of the processing target matter 20 is not limited, the impermeable recording medium such as the coated paper or the slow-permeable recording medium is used as the processing target matter 20, the printing apparatus 170 in the present embodiment can further exhibit effects.

In the example as illustrated in FIG. 21, the four discharge heads (171Y, 171M, 171C, and 171K) of four colors are aligned along the main-scanning direction. Each of the discharge heads of the colors includes a plurality of nozzles aligned in the sub-scanning direction (see, direction of the arrow Y in FIG. 21 to FIG. 23). Ink droplets corresponding to pixels of the image data are discharged through the nozzles.

In the present embodiment, the nozzles provided on the discharge heads of the colors are divided into four groups (hereinafter, referred to as nozzle groups) along the sub-scanning direction (direction of the arrow Y). Accordingly, the nozzle groups of four colors are aligned on each row in the main-scanning direction. In this case, the recording unit 171 as illustrated in FIG. 21 includes nozzle groups (a) to (d). In the following description, a band-like region on which printing is performed by one scanning through the nozzle groups (a) to (d) or an image printed on the band-like region is referred to as a band.

The nozzles of the nozzle groups (a) to (d) are fixed in a deviated manner so as to interpolate intervals in order to form an image having high resolution (for example, 1200 dpi). For example, the recording unit 171 covers driving frequencies of a plurality of types such that liquid droplets of the ink to be discharged through the nozzles can be volumes of three types called large droplets, middle droplets, and small droplets. The driving frequency is input to the recording unit 171 from a driving circuit (not illustrated) connected to the controller 160.

The discharge electrodes 11*a* to 11*d* and 11*w* to 11*z* provided on the plasma processor 101 are mounted at both sides of the recording unit 171 such that the recording unit 171 is interposed therebetween in the scanning direction. In FIG. 21 and FIG. 22, the discharge electrodes arranged at one side of the recording unit 171 are assumed to be the discharge electrodes 11*a* to 11*d* (to configure a plasma processor 101A) and the discharge electrodes arranged at the opposite side to the discharge electrodes 11*a* to 11*d* are assumed to be the discharge electrodes 11*w* to 11*z* (to configure a plasma processor 101B).

The length of each of the discharge electrodes 11*a* to 11*d* and 11*w* to 11*z* is identical to the length (hereinafter, referred to as band width) of each of the nozzle groups (a) to (d) of the recording unit 171 along the sub-scanning direction, for example. When a four-scan multi-scan head is used, the band width is a quarter of the length of the entire recording unit 171 along the sub-scanning direction. In this case, the length of each of the discharge electrodes 11*a* to 11*d* and 11*w* to 11*z* along the sub-scanning direction is also set to a quarter of the length of the entire recording unit 171 in the same manner as the band width.

The length of each of the discharge electrodes 11*a* to 11*d* and 11*w* to 11*z* may be the length of each of the nozzles along the sub-scanning direction and is not limited to be identical to the band width.

As illustrated in FIG. 23, the plasma processor 101 having the discharge electrodes 11*a* to 11*d* and 11*w* to 11*z* includes high-frequency high-voltage power supplies 15*a* to 15*d* and 15*w* to 15*z* (the high-frequency high-voltage power supplies 15*w* to 15*z* are not illustrated in FIG. 23) provided for the discharge electrodes 11*a* to 11*d* and 11*w* to 11*z*, respectively, the dielectric material 12 and the counter electrode 14 arranged so as to oppose the entire movement region of the discharge electrodes 11*a* to 11*d* and 11*w* to 11*z*, and the controller 160 controlling the high-frequency high-voltage power supplies 15*a* to 15*d* and 15*w* to 15*z*. For example, the dielectric material 12 is provided between the discharge electrodes 11*a* to 11*d* and 11*w* to 11*z* and the counter electrode 14 at the counter electrode 14 side. The dielectric material 12 is not limited to be provided in this manner and may be provided at the side of the discharge electrodes 11*a* to 11*d* and 11*w* to 11*z*. In this case, the dielectric material 12 may be divided into a plurality of pieces in accordance with arrangement of the discharge electrodes 11*a* to 11*d* and 11*w* to 11*z*.

The dielectric material 12 and the counter electrode 14 as illustrated in FIG. 23 have sizes covering an entire movement range of the discharge electrodes 11*a* to 11*d* and 11*w* to 11*z*, for example. A gap through which the processing target matter 20 passes is provided between the discharge electrodes 11*a* to 11*d* and 11*w* to 11*z* and the counter electrode 14. A distance of the gap may be such distance that the passing processing target matter 20 makes contact with the discharge electrodes 11*a* to 11*d* and 11*w* to 11*z* or such distance that the passing processing target matter 20 does not make contact with the discharge electrodes 11*a* to 11*d* and 11*w* to 11*z*.

The high-frequency high-voltage power supplies 15*a* to 15*d* and 15*w* to 15*z* supply pulse voltages each having a voltage of approximately 10 kV (p-p) and a frequency of approximately 20 kHz to between the discharge electrodes 11*a* to 11*d* and 11*w* to 11*z* and the counter electrode 14, respectively, in accordance with control performed by the controller 160 so as to generate atmospheric-pressure non-equilibrium plasma on a conveyance path of the processing target matter 20. The plasma energy in this case can be calculated from the voltage value of the high-frequency high-voltage pulses supplied to the discharge electrodes 11*a* to 11*d* and 11*w* to 11*z* and application time thereof, and an electric current that flows through the processing target matter 20 at the time of the application.

The controller 160 can individually turn ON/OFF the high-frequency high-voltage power supplies 15*a* to 15*d* and 15*w* to 15*z*. That is to say, the controller 160 individually turns ON/OFF the high-frequency high-voltage power supplies 15*a* to 15*d* and 15*w* to 15*z* so as to control the plasma energy that is applied to the processing target matter 20.

The controller 160 may control the plasma energy by selectively driving the high-frequency high-voltage power supplies 15*a* to 15*d* and 15*w* to 15*z*. The controller 160 may control the plasma energy by combining scanning by the head unit 173 and ON/OFF control of the high-frequency high-voltage power supplies 15*a* to 15*d* and 15*w* to 15*z*.

In the example as illustrated in FIG. 21, the nozzle groups (a) to (d) and the discharge electrodes 11*a* to 11*d* or 11*w* to 11*z* one-to-one correspond to each other. That is to say, for a band that is the ink discharge target region of one nozzle group (for example, nozzle group (a)), the discharge electrode 11 corresponding thereto performs the plasma processing. In this case, the plasma processing and the printing processing are executed by one scanning, thereby executing the printing processing efficiently.

The nozzle groups may be divided more finely and the discharge electrode 11 may be arranged so as to correspond to each nozzle group. The discharge electrode 11 having the width (length in the direction of the arrow Y) corresponding to the nozzle width (width of the nozzle in the sub-scanning direction (direction of the arrow Y) may be arranged for each of the nozzles aligned in the sub-scanning direction (direction of the arrow Y). This configuration can further subdivide a region on which the plasma processor 101 performs the plasma processing and perform the plasma processing with desired plasma energy for each desired region.

An overlap recording system can be employed as an image recording method used by the recording unit 171 having the nozzles aligned in the main-scanning direction (direction of the arrow X). The overlap recording system is a recording system by which an image of one main scanning line is completed by performing printing a plurality of number of times using different nozzles for the same main scanning line. Alternatively, a multi-pass system by which an image is formed by repeating scanning in the main-scanning direction with the nozzles corresponding to a plurality of passes can also be employed as the image recording method by the recording unit 171.

The heating unit 103 heats the ink discharge region of the processing target matter 20. It is sufficient that the heating unit 103 can heat at least the ink discharge region of the processing target matter 20 and the heating unit 103 may heat the entire region of the processing target matter 20.

When the heating unit 103 heats the ink discharge region of the processing target matter 20, moisture contained in the ink discharged (or that is being discharged) onto the ink discharge region evaporates and the pigment aggregates. The heating can further suppress generation of the bleeding (blur on color boundaries) and the beading (density unevenness due to unification of dots).

As described above, the ink discharge region indicates both of the ink discharge target region and the region on which the ink has been discharged on the processing target matter 20. That is to say, the ink discharge target region of the processing target matter 20 corresponds to the ink discharge region before the dots with the ink are recorded or at timing at which the dots with the ink are recorded. The region onto which the ink has been discharged corresponds to the ink discharge region at timing after the dots with the ink are recorded.

It is sufficient that the heating unit 103 is a device capable of applying heat to the processing target matter 20 while not making contact with the ink discharge target region or the region on which the ink has been discharged on the processing target matter 20. In the present embodiment, a case will be described where a main body of the heating unit 103 is a device generating heat, as an example. That is to say, in the present embodiment, a case will be described where the ink discharge region of the processing target matter 20 is heated with heat generated by heat generation of the main body of the heating unit 103, as an example.

The heating unit 103 is arranged at a position capable of heating the ink discharge region of the processing target matter 20 at at least one of first timing, second timing, and third timing. The first timing is timing before the ink is discharged and the dots are recorded onto the processing target matter 20. The first timing may be timing before the dots are recorded by the recording unit 171 and the plasma processing is performed or timing before the dots are recorded and after the plasma processing is performed. The second timing is timing at which the dots are recorded on the processing target matter 20 by the recording unit 171. The third timing is timing after the dots are recorded on the processing target matter 20 by the recording unit 171.

In the present embodiment, the heating unit 103 is arranged such that the recording unit 171 and the detector 102 are interposed therebetween in the main-scanning direction (direction of the arrow X). The heating unit 103 includes a heating unit 103B provided at the plasma processor 101A side (at an arrow XA direction side) of the recording unit 171 and a heating unit 103A provided at the plasma processor 101B side (at an arrow XB direction side) of the recording unit 171.

When the head unit 173 is moved to the arrow XA direction side in the main-scanning direction, the heating unit 103A heats the ink discharge region on which the plasma processor 101A has performed the plasma processing and the recording unit 171 has recorded the dots. The controller 160 controls the driving of the head unit 173, the plasma processor 101A, the recording unit 171, and the heating unit 103A such that the plasma processing, the recording of the dots, and the heating are performed in this order.

When the head unit 173 is moved to the arrow XB direction side in the main-scanning direction, the heating unit 103B heats the ink discharge region on which the plasma processor 101B has performed the plasma processing and the recording unit 171 has recorded the dots. The controller 160 controls the driving of the head unit 173, the plasma processor 101B, the recording unit 171, and the heating unit 103B such that the plasma processing, the recording of the dots, and the heating are performed in this order.

In the example as illustrated in FIG. 21, the heating unit 103 (the heating unit 103A and the heating unit 103B) is provided at a position capable of heating the ink discharge region of the processing target matter 20 at the second timing. The heating unit 103 may heat the ink discharge region of the processing target matter 20 at any of the first timing, the second timing, and the third timing by adjusting the heating timing by the heating unit 103 and arrangement of the heating unit 103. An installation position of the heating unit 103 and other conditions may be adjusted so as to heat the ink discharge region of the processing target matter 20 at equal to or more than two timings of the first timing, the second timing, and the third timing.

The controller 160 adjusts the heating energy by the heating unit 103. The heating energy is defined by the heating time and the heating temperature. The heating unit 103 heats the processing target matter 20 at a heating temperature of 30° C. to 60° C., for example, although depending on the types of the ink.

Discharge failure occurs due to ink clogging or other problems in nozzle discharge ports of the recording unit 171 because of the heating of the processing target matter 20 performed by the heating unit 103 in some cases. In order to prevent the discharge failure, the heating temperature by the heating unit 103 is preferably adjusted in a temperature range in which the ink discharge failure does not occur.

The detector 102 detects the surface temperature of the processing target matter 20 at the time of the recording of the dots performed by the recording unit 171. It is sufficient that the detector 102 is a well-known device capable of detecting the surface temperature of the processing target matter 20. In the present embodiment, the detector 102 includes a detector 102A and a detector 102B.

In the present embodiment, the detector 102A and the detector 102B are arranged on the head unit 173. The detector 102A and the detector 102B are installed such that the recording unit 171 is interposed between the detector 102A and the detector 102B in the scanning direction (direction of the arrow X). In the example as illustrated in FIG. 21 and FIG. 22, the detector 102A is arranged between the recording unit 171 and the plasma processor 101B. The detector 102B is arranged between the recording unit 171 and the plasma processor 101A.

When the head unit 173 is made to scan in one (for example, direction of the arrow XA, see FIG. 21 and FIG. 22) of the main-scanning direction (direction of the arrow X), the recording unit 171 discharges the ink and records the dots on the region on which the plasma processor 101A has performed the plasma processing, the detector 102A detects the surface temperature of the processing target matter 20, and the heating unit 103A heats the processing target matter 20. The controller 160 controls the driving of the head unit 173, the plasma processor 101A, the recording unit 171, the detector 102A, and the heating unit 103A such that the plasma processing, the recording of the dots, the detection of the surface temperature, and the heating are performed in this order.

When the head unit 173 is made to scan in the other (for example, direction of the arrow XB, see FIG. 21 and FIG. 22) of the main-scanning direction (direction of the arrow X), the recording unit 171 discharges the ink and records the dots on the region on which the plasma processor 101B has performed the plasma processing, the detector 102B detects the surface temperature of the processing target matter 20, and the heating unit 103B heats the processing target matter 20. The controller 160 controls the driving of the head unit 173, the plasma processor 101B, the recording unit 171, the detector 102B, and the heating unit 103B such that the plasma processing, the recording of the dots, the detection of the surface temperature, and the heating are performed in this order.

It is sufficient that an installation position of the detector 102 (detector 102A and detector 102B) is a position capable of detecting the surface temperature of the processing target matter 20 at the time of the recording of the dots and the installation position is not limited to the above-mentioned position.

The controller 160 controls at least one of the plasma energy by the plasma processor 101 and the heating energy by the heating unit 103 such that the predetermined dots are recorded on the processing target matter 20.

Figure 24:
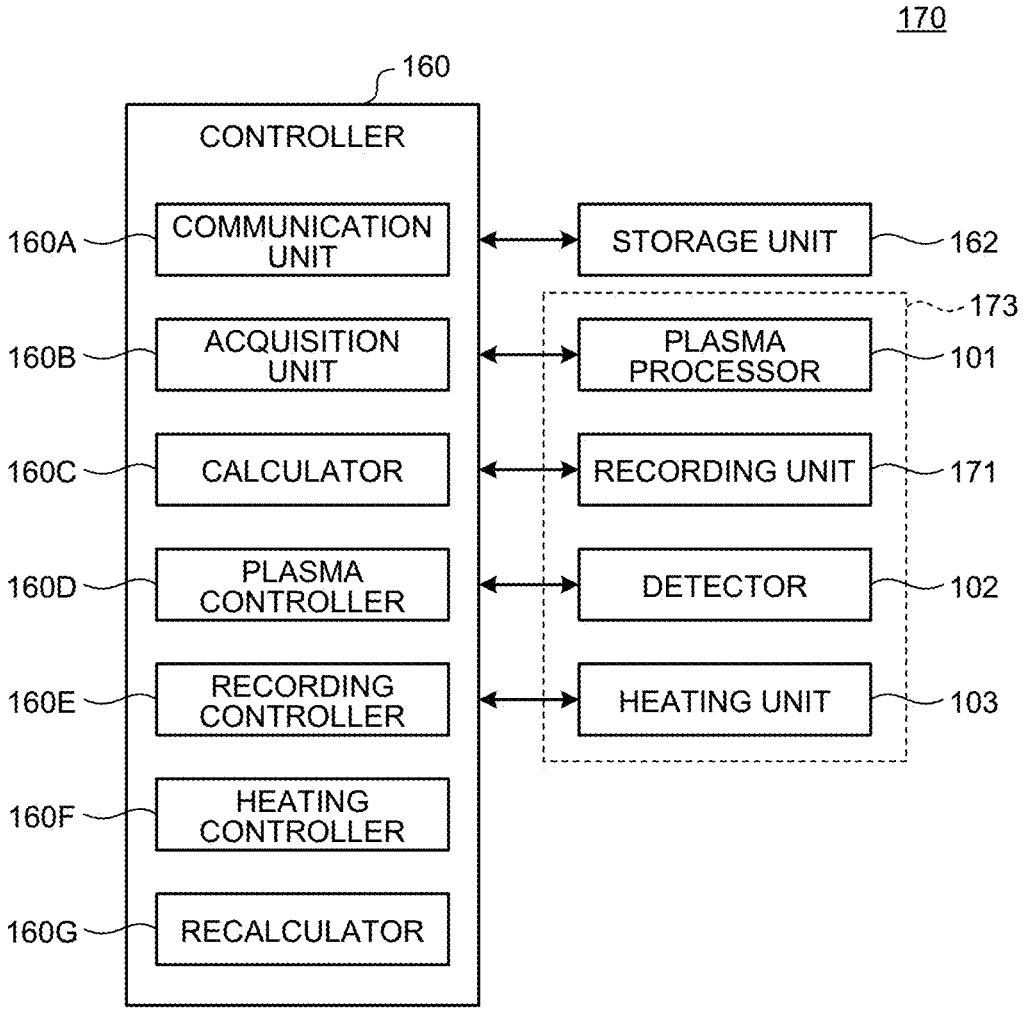
FIG. 24 is a functional block diagram illustrating a printing apparatus.

FIG. 24 is a functional block diagram illustrating the printing apparatus 170.

The printing apparatus 170 includes the controller 160, a storage unit 162, the plasma processor 101, the recording unit 171, the detector 102, and the heating unit 103. The controller 160, the storage unit 162, the plasma processor 101, the recording unit 171, the detector 102, and the heating unit 103 are connected to one another so as to transmit and receive pieces of data and signals. As described above, the plasma processor 101, the recording unit 171, the detector 102, and the heating unit 103 configure the head unit 173. The storage unit 162 stores therein pieces of data of various types.

The controller 160 is a computer configured by including a central processing unit (CPU) and controls the entire printing apparatus 170. It should be noted that the controller 160 may be configured by circuitry, for example, other than the CPU.

The controller 160 includes a communication unit 160A, an acquisition unit 160B, a calculator 160C, a plasma controller 160D, a recording controller 160E, a heating controller 160F, and a recalculator 160G. Some or all of the communication unit 160A, the acquisition unit 160B, the calculator 160C, the plasma controller 160D, the recording controller 160E, the heating controller 160F, and the recalculator 160G may be made to function by causing a processing device such as a CPU to execute a computer program, that is, by software, by hardware such as an integrated circuit (IC), or by software and hardware in combination.

The communication unit 160A communicates with an external device (not illustrated), for example, through the Internet or other network. In the present embodiment, the communication unit 160A receives print data from the external device. The print data contains image data of an image as a recording target by the recording unit 171 and setting information. The setting information contains a printing mode, a type of the processing target matter 20 as an image formation target, and a type of the ink in the present embodiment. The printing mode contained in the setting information is high resolution (that is, image quality priority) or low resolution (that is, printing speed priority), for example.

The acquisition unit 160B acquires the printing mode, the type of the processing target matter 20, the type of the ink that is discharged onto the processing target matter 20, and an amount of the ink that is discharged onto the processing target matter 20.

For example, the acquisition unit 160B reads the setting information contained in the print data so as to acquire the printing mode, the type of the processing target matter 20, and the type of the ink. The controller 160 calculates the amount of the ink that is discharged onto the processing target matter 20 based on the printing mode so as to acquire the amount of the ink.

The recording unit 171 can discharge the ink of large droplets, middle droplets, and small droplets with different discharge amounts. The amounts of the ink of large droplets, middle droplets, and small droplets are defined by the resolution indicated by the printing mode. For example, as for small droplets, as the resolution is higher, the amount of the ink that is discharged is smaller.

The storage unit 162 previously stores therein the amounts of the ink corresponding to small droplets, middle droplets, and large droplets for each resolution. The recording unit 171 discharges the ink in the ink amounts correlating to the sizes (in small droplets, middle droplets, or large droplets) in accordance with the resolution and pixel values of pixels indicated by the image data through the corresponding nozzles at scanning positions corresponding to the pixels at pixel positions.

That is to say, the recording controller 160E controls the recording unit 171 so as to discharge the ink in the amounts in accordance with the resolution and the pixel values of the pixels in the image data through the corresponding nozzles at the scanning positions corresponding to the pixels at the pixel positions.

The amounts of the ink that is discharged onto regions corresponding to the pixels on the processing target matter 20 are therefore defined by the resolution of the image at the time of printing and the pixel values of the pixels indicated by the image data. Accordingly, it is sufficient that the acquisition unit 160B calculates the amounts of ink that is discharged based on the resolution indicated by the printing mode contained in the setting information and the gradation values (pixel values) of the pixels indicated by the image data.

The acquisition unit 160B may acquire the printing mode, the type of the processing target matter 20, the type of the ink from an operation unit. The operation unit is a device that is used when a user inputs pieces of information of various types. The operation unit is a keyboard or a touch panel, for example. In this case, it is sufficient that the printing apparatus 170 further includes the operation unit and the operation unit and the controller 160 are connected to each other so as to transmit and receive signals.

Furthermore, the printing apparatus 170 may include a sensor detecting the type of the processing target matter 20 and the type of the ink. In this case, it is sufficient that the acquisition unit 160B acquires the type of the processing target matter 20 and the type of the ink from the sensor. The type of the processing target matter 20 that is defined by the thickness and the nature of the processing target matter 20 may be measured by measuring an electric resistance of the processing target matter 20 with a measurement device. In this case, the acquisition unit 160B may acquire the type of the processing target matter 20 from the measurement device.

The calculator 160C calculates the plasma energy by the plasma processor 101 and the heating energy by the heating unit 103 that are used for recording the predetermined dots on the processing target matter 20.

The calculator 160C may set one of the plasma energy and the heating energy to be a constant value and set the other of them to be variable and calculate the other one. Alternatively, the calculator 160C may set both of the plasma energy and the heating energy to be variable and calculate both energies.

The predetermined dots indicate dots having at least one of a predetermined diameter, a predetermined shape, and a predetermined density distribution. To be specific, the predetermined diameter is a diameter of an ideal dot corresponding to the amount (in large droplets, middle droplets, or small droplets) of the ink that is discharged. The predetermined shape is a complete round shape, for example. The predetermined density distribution is uniform density distribution in each dot.

In the present embodiment, the calculator 160C calculates the plasma energy and the heating energy for recording the predetermined dots on the processing target matter 20 in accordance with at least one of the printing mode, the type of the processing target matter 20, the amount of the ink that is discharged onto the processing target matter 20, and the type of the ink that is discharged onto the processing target matter 20.

For example, the storage unit 162 previously stores therein the plasma energy and the heating energy for recording the predetermined dots corresponding to the printing mode, the type of the processing target matter 20, the type of the ink discharged onto the processing target matter 20, and the amount of the ink that is discharged.

The calculator 160C reads the plasma energy and the heating energy corresponding to the printing mode, the type of the processing target matter 20, the type of the ink that is discharged onto the processing target matter 20, and the amount of the ink that is discharged, which have been acquired by the acquisition unit 160B, from the storage unit 162. It is sufficient that the calculator 160C calculates the plasma energy and the heating energy for recording the predetermined dots by this reading.

It is sufficient that the user uses the printing apparatus 170 to previously measure the plasma energy and the heating energy for causing the predetermined target dots to be recorded using the printing modes of a plurality of types, the processing target matters 20 of a plurality of types, the inks of a plurality of types, and the amounts of the ink of a plurality of types. Furthermore, it is sufficient that the controller 160 performs control to previously store, in the storage unit 162, the measured conditions (combinations of the printing modes, the types of the processing target matter 20, the types of the ink, and the amounts of the ink) and the plasma energy and the heating energy for recording the predetermined target dots (dots having the target shape, diameter, and density distribution) corresponding to each other.

For example, it is sufficient that the controller 160 performs control to form an image on the processing target matter 20 while varying the conditions (combination of the printing mode, the type of the processing target matter 20, the type of the ink, and the amount of the ink) and to store, in the storage unit 162, the plasma energy and the heating energy with which preferable target dots are formed as the plasma energy and the heating energy corresponding to the conditions.

When a plurality of preferable evaluation results are provided, any combination of the heating energy and the plasma energy may be stored in the storage unit 162. It is, however, preferable that among the preferable evaluation results, a combination of the plasma energy and the heating energy at least one of which is lower be stored in the storage unit 162 in terms of improvement in productivity and reduction in energy consumption.

To be specific, it is assumed that the evaluation results as illustrated in FIG. 18 and FIG. 19 are provided. In this case, it is sufficient that the plasma energy and the heating energy (defined by the heating time and the heating temperature) corresponding to the value "5" indicating a preferable evaluation result are stored in the storage unit 162 as the plasma energy and the heating energy corresponding to the measurement conditions (the printing mode, the type of the processing target matter 20, the type of the ink, and the amount of the ink) with which the evaluation result was provided.

When a plurality of preferable evaluation results (for example, the value "5" indicating a preferable evaluation result) are provided, any combination of the heating energy and the plasma energy may be stored in the storage unit 162. It is, however, preferable that among the preferable evaluation results, a combination of the plasma energy and the heating energy at least one of which is lower be stored in the storage unit 162 in terms of improvement in productivity and reduction in energy consumption.

When the heating temperature by the heating unit 103 is excessively high, discharge failure due to the drying of the nozzles occurs in some cases. Furthermore, as the printing speed is higher, the plasma energy by the plasma processor 101 is required to be increased. In order to avoid these disadvantages, the plasma energy and the heating energy when the preferable evaluation result is provided in a state where the plasma energy is lower and the heating temperature is set in a temperature range causing no discharge failure of the nozzles are preferably specified and stored in the storage unit 162.

The plasma controller 160D controls the plasma processor 101 so as to perform the plasma processing on the surface of the processing target matter 20 with the plasma energy calculated by the calculator 160C.

For example, the plasma controller 160D controls the plasma processor 101 so as to perform the plasma processing on the surface of the processing target matter 20 with the calculated plasma energy by controlling selection of the discharge electrode 11 to which a voltage is applied among the discharge electrodes 11*a* to 11*d* and 11*w* to 11*z* provided on the plasma processor 101, a voltage value of the voltage that is applied to the discharge electrode 11, the voltage application time, the scanning speed of the carriage 172 in the main-scanning direction (direction of the arrow X), the conveyance timing of the processing target matter 20 in the sub-scanning direction (direction of the arrow Y), and other conditions in combination.

The heating controller 160F controls the heating unit 103 so as to heat at least the ink discharge region of the processing target matter 20 with the heating energy calculated by the calculator 160C.

For example, the heating controller 160F controls the heating unit 103 so as to heat at least the ink discharge region of the processing target matter 20 with the calculated heating energy by adjusting the heating time and the heating temperature by the heating unit 103.

The controller 160 therefore controls at least one of the plasma energy by the plasma processor 101 and the heating energy by the heating unit 103 such that the predetermined dots are recorded on the processing target matter 20.

The controller 160 may set the plasma energy by the plasma processor 101 to be constant and adjust the heating energy by the heating unit 103. Alternatively, the controller 160 may set the heating energy by the heating unit 103 to be constant and adjust the plasma energy by the plasma processor 101.

The controller 160 controls at least one of the plasma energy and the heating energy such that the predetermined dots are recorded on the processing target matter 20 in accordance with the printing mode used by the recording unit 171, the type of the processing target matter 20, the amount of the ink that is discharged onto the processing target matter 20, and the type of the ink that is discharged onto the processing target matter 20.

It is sufficient that the controller 160 controls at least one of the plasma energy and the heating energy in accordance with at least one of the printing mode used by the recording unit 171, the type of the processing target matter 20, the amount of the ink that is discharged onto the processing target matter 20, and the type of the ink that is discharged onto the processing target matter 20.

The surface temperature of the processing target matter 20 is different from a target heating temperature (hereinafter, referred to as a target temperature) for the heating unit 103 in some cases depending on the thicknesses of the processing target matter 20, environment temperatures, and other conditions.

The recalculator 160G acquires a detection result of the surface temperature from the detector 102. Then, the recalculator 160G recalculates at least one of the plasma energy and the heating energy for recording the predetermined dots on the processing target matter 20 in accordance with the acquired surface temperature.

To be specific, the recalculator 160G recalculates the plasma energy and the heating energy calculated by the calculator 160C in accordance with the acquired surface temperature.

To be specific, it is assumed that the acquired surface temperature is lower than the target temperature for the heating unit 103. The target temperature for the heating unit 103 is a heating temperature that is indicated by the heating energy calculated by the calculator 160C. In other words, the target temperature for the heating unit 103 is a heating temperature by the heating unit 103 that is currently controlled by the heating controller 160F.

When the acquired surface temperature is thus lower than the target temperature, the recalculator 160G sets the heating energy to be constant at the heating energy that is currently given by the heating unit 103. The recalculator 160G calculates the plasma energy higher than the plasma energy that is currently given by the plasma processor 101. For example, as the detected surface temperature is lower than the target temperature, the recalculator 160G recalculates a value obtained by multiplying the plasma energy that is currently given by the plasma processor 101 by a larger factor (value larger than 1), as new plasma energy.

When the acquired surface temperature is identical to the target temperature, the recalculator 160G does not recalculate the plasma energy and the heating energy.

When the acquired surface temperature is higher than the target temperature, it is sufficient that the recalculator 160G recalculates the plasma energy and the heating energy so as to provide at least one of the plasma energy lower than the plasma energy that is currently given and the heating energy lower than the heating energy that is currently given.

When the recalculator 160G recalculates the plasma energy, the plasma controller 160D controls the plasma processor 101 so as to perform the plasma processing with the recalculated plasma energy. When the recalculator 160G recalculates the heating energy, the heating controller 160F controls the heating unit 103 so as to use the recalculated heating energy for heating.

The controller 160 therefore controls at least one of the plasma energy by the plasma processor 101 and the heating energy by the heating unit 103 such that the predetermined dots are formed on the processing target matter 20 in accordance with the detected surface temperature. When the detected surface temperature is lower than the target temperature for the heating unit 103, the controller 160 performs control to increase at least one of the plasma energy and the heating energy.

Figure 25:
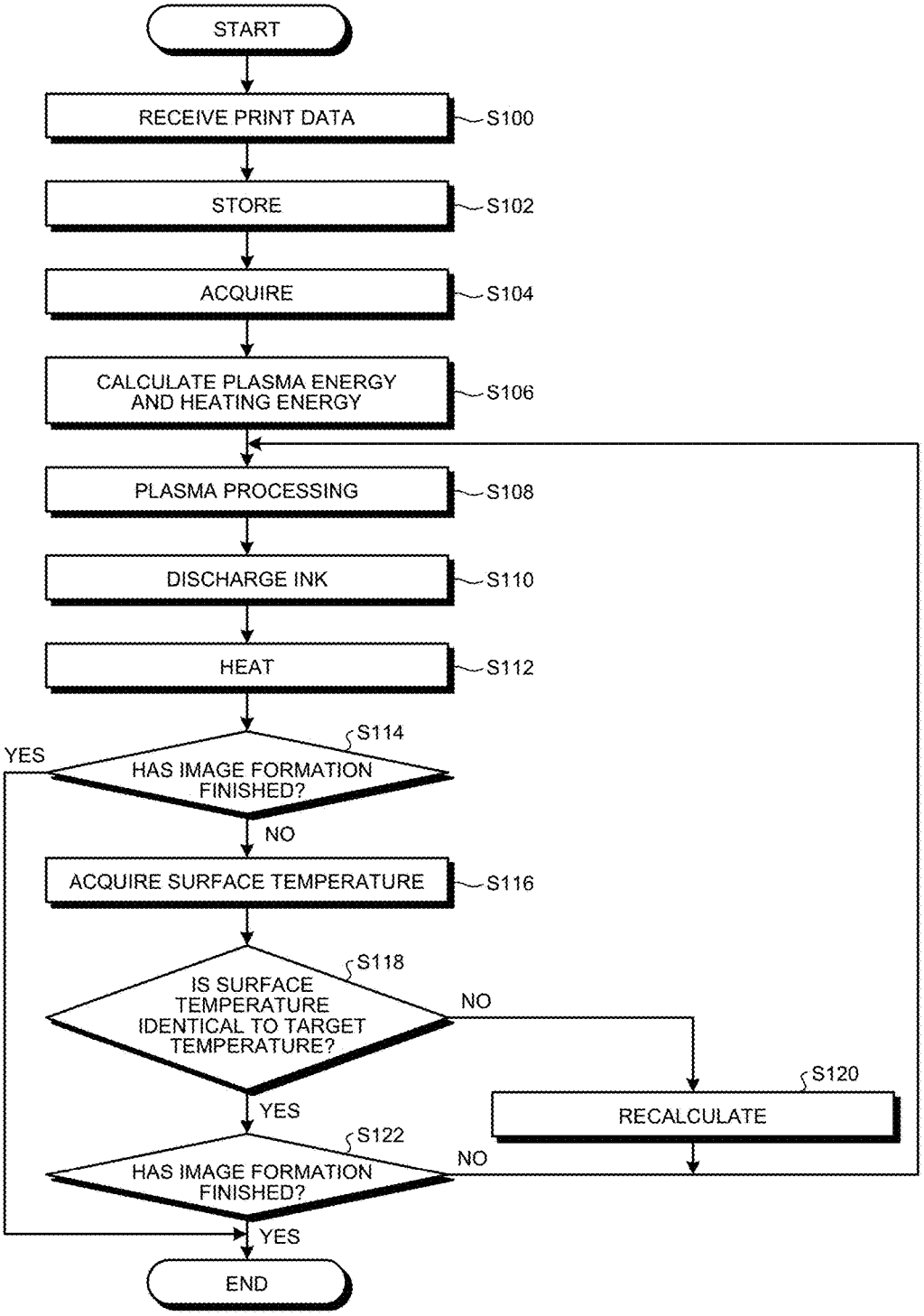
FIG. 25 is a flowchart illustrating a procedure for printing processing.

Next, a procedure for the printing processing that is executed by the printing apparatus 170 will be described. FIG. 25 is a flowchart illustrating the procedure for the printing processing that is executed by the printing apparatus 170.

First, the communication unit 160A receives print data from the external device (step S100). Then, the communication unit 160A stores the received print data in the storage unit 162 (step S102).

The acquisition unit 160B acquires the printing mode, the type of the processing target matter 20, the type of the ink, and the amount of the ink (step S104).

Thereafter, the calculator 160C calculates the plasma energy and the heating energy for recording the predetermined dots on the processing target matter 20 in accordance with the printing mode, the type of the processing target matter 20, the amount of the ink, and the type of the ink that have been acquired at step S104 (step S106).

The plasma controller 160D controls the plasma processor 101 so as to perform the plasma processing on the surface of the processing target matter 20 with the plasma energy calculated at step S106 (step S108).

The recording controller 160E controls the recording unit 171 so as to discharge the ink in accordance with the pixel values of the pixels and the resolution indicated by the image data contained in the print data received at step S100 (step S110).

The heating controller 160F controls the heating unit 103 so as to heat at least the ink discharge region of the processing target matter 20 with the heating energy calculated at step S106 (step S112).

In the pieces of processing at step S108 to step S112, the controller 160 controls scanning of the head unit 173 and the conveyance of the processing target matter 20.

Subsequently, the controller 160 determines whether an image of the image data contained in the print data has been formed (step S114). When positive determination is made at step S114 (Yes at step S114), this routine is finished.

When negative determination is made at step S114 (No at step S114), the process proceeds to step S116.

At step S116, the recalculator 160G acquires the surface temperature of the processing target matter 20 from the detector 102 (step S116). Then, the recalculator 160G determines whether the acquired surface temperature is identical to the target temperature (step S118). When the acquired surface temperature is not identical to the target temperature (No at step S118), the process proceeds to step S120. At step S120, the recalculator 160G recalculates the plasma energy and the heating energy using the surface temperature acquired at step S116 (step S120). Then, the process returns to step S108.

When the pieces of processing at step S108 and step S112 are executed after the recalculation at step S120, it is sufficient that the plasma controller 160D controls the plasma processor 101 so as to perform the plasma processing with the recalculated plasma energy at step S108. It is sufficient that the heating controller 160F controls the heating unit 103 so as to use the recalculated heating energy at step S112 for heating.

In contrast, in the determination at step S118, when the acquired surface temperature and the target temperature are identical (Yes at step S118), the process proceeds to step S122. At step S122, the controller 160 determines whether an image of the image data contained in the print data has been formed (step S122). When negative determination is made at step S122 (No at step S122), the process returns to step S108. When positive determination is made at step S122 (Yes at step S122), this routine is finished.

As described above, the printing apparatus 170 in the present embodiment includes the plasma processor 101, the recording unit 171, and the heating unit 103. The plasma processor 101 performs the plasma processing on the processing target matter 20. The recording unit 171 discharges the ink and records the dots onto the processing target matter 20 on which the plasma processing has been performed. The heating unit 103 heats the ink discharge region of the processing target matter 20.

The printing apparatus 170 in the present embodiment thus discharges the ink and records the dots onto the processing target matter 20 on which the plasma processor 101 has performed the plasma processing and heats the ink discharge region of the processing target matter 20 by the heating unit 103.

Accordingly, the printing apparatus 170 in the present embodiment can reduce deterioration in image quality.

Even when the printing speed is set to be high, the printing apparatus 170 in the present embodiment can reduce the deterioration in image quality. The printing apparatus 170 can improve the productivity in addition to the above-mentioned effect.

The printing apparatus 170 in the present embodiment roughens the surface of the processing target matter 20 by the plasma processing, discharges the ink and records the dots thereon, and heats the processing target matter 20. The printing apparatus 170 in the present embodiment can therefore improve scratch resistance and robustness of an image formed on the processing target matter 20.

When the impermeable recording medium or the slow-permeable recording medium is employed as the processing target matter 20, the printing apparatus 170 in the present embodiment can reduce the deterioration in image quality particularly effectively. When aqueous ink is used as the type of the ink, the printing apparatus 170 can reduce the deterioration in image quality particularly effectively.

The heating unit 103 of the printing apparatus 170 in the present embodiment heats the ink discharge region of the processing target matter 20 at at least one timing of the first timing before the dots are recorded, the second timing at which the dots are recorded, and the third timing after the dots are recorded.

The printing apparatus 170 in the present embodiment further includes the controller 160. The controller 160 controls at least one of the plasma energy by the plasma processor 101 and the heating energy by the heating unit 103 such that the predetermined dots are recorded on the processing target matter 20.

The predetermined dots indicate dots having at least one of the predetermined diameter, the predetermined shape, and the predetermined density distribution.

The controller 160 controls at least one of the plasma energy by the plasma processor 101 and the heating energy by the heating unit 103 such that the predetermined dots are recorded on the processing target matter 20 in accordance with at least one of the printing mode used by the recording unit 171, the type of the processing target matter 20, the amount of the ink that is discharged onto the processing target matter 20, and the type of the ink that is discharged onto the processing target matter 20.

The printing apparatus 170 in the present embodiment can therefore record the predetermined target dots in accordance with the printing conditions. Accordingly, the printing apparatus 170 can further improve the productivity, achieve energy saving, and further improve image quality in addition to the above-mentioned effects. Moreover, an ink consumption amount can also be reduced.

The printing apparatus 170 in the present embodiment further includes the detector 102. The detector 102 detects the surface temperature of the processing target matter 20 at the time of the recording of the dots. In this case, the controller 160 controls at least one of the plasma energy by the plasma processor 101 and the heating energy by the heating unit 103 such that the predetermined dots are formed on the processing target matter 20 in accordance with the detected surface temperature.

The surface of the processing target matter 20 heated by the heating unit 103 is not identical to the target temperature in some cases depending on the types of the processing target matter 20, the environment temperatures, and other conditions. The controller 160 preferably controls at least one of the plasma energy and the heating energy in accordance with the surface temperature detected by the detector 102. With this control, the surface of the processing target matter 20 can be adjusted to the target temperature for the heating unit 103 regardless of the types of the processing target matter 20, the environment temperatures, and other conditions. The printing apparatus 170 in the present embodiment can therefore perform printing (image formation) with stable image quality in addition to the above-mentioned effects.

When the detected surface temperature is lower than the target temperature for the heating unit 103, the controller 160 performs control to increase at least one of the plasma energy and the heating energy. The printing apparatus 170 in the present embodiment can therefore perform printing with stable image quality regardless of the types of the processing target matter 20, the environment temperatures, and other conditions, in addition to the above-mentioned effects.

In the present embodiment, the heating unit 103 can heat the ink discharge region of the processing target matter 20 with heat generated by heat generation of the heating unit 103. The controller 160 can control the heating energy by the heating unit 103 by controlling the heating temperature as the heat generation temperature by the heating unit 103 and the heating time by the heating unit 103.

In the present embodiment, the storage unit 162 stores therein the plasma energy and the heating energy for recording the target dots corresponding to the printing mode, the type of the processing target matter, the amount of the ink that is discharged onto the processing target matter 20, and the type of the ink that is discharged onto the processing target matter 20.

Alternatively, the storage unit 162 may register therein conditions for executing the plasma processing with the plasma energy instead of the plasma energy. For example, the storage unit 162 may register therein, instead of the plasma energy, combined values of the number of times of drives of the discharge electrodes 11 of the plasma processor 101, the voltage value of the voltage that is applied to the discharge electrodes 11, the voltage application time, the scanning speed of the carriage 172 in the main-scanning direction (scanning direction), the number of scans (the number of passes), the conveyance timing of the processing target matter 20 in the sub-scanning direction, and other conditions.

In the same manner, the storage unit 162 may register therein the heating temperature and the heating time instead of the heating energy, for example. For example, the heating time may be the scanning speed of the carriage 172 in the main-scanning direction (scanning direction), the number of scans (the number of passes), the conveyance timing of the processing target matter 20 in the sub-scanning direction, or other conditions. When the plasma processor 101 and the heating unit 103 are mounted on the carriage 172, it is sufficient that values of the scanning speed of the carriage 172 in the main-scanning direction (scanning direction), the number of scans (the number of passes), and the conveyance timing of the processing target matter 20 in the sub-scanning direction for the heating energy stored in the storage unit 162 may be set to the same values as those for the corresponding plasma energy stored in the storage unit 162.

The printing apparatus 170 may further include a density detector detecting a density of the image with the dots recorded by the recording unit 171. In this case, the controller 160 may further adjust at least one of the plasma energy and the heating temperature in accordance with the image density detected by the density detector such that a density indicated by the image data of the image is provided.

Second Embodiment

In the above-mentioned embodiment, the printing apparatus 170 employs the multi-pass system as the inkjet recording system, as an example. The inkjet recording system by the printing apparatus 170 is not, however, limited to the multi-pass system and may be a single-pass system, for example.

Figure 26:
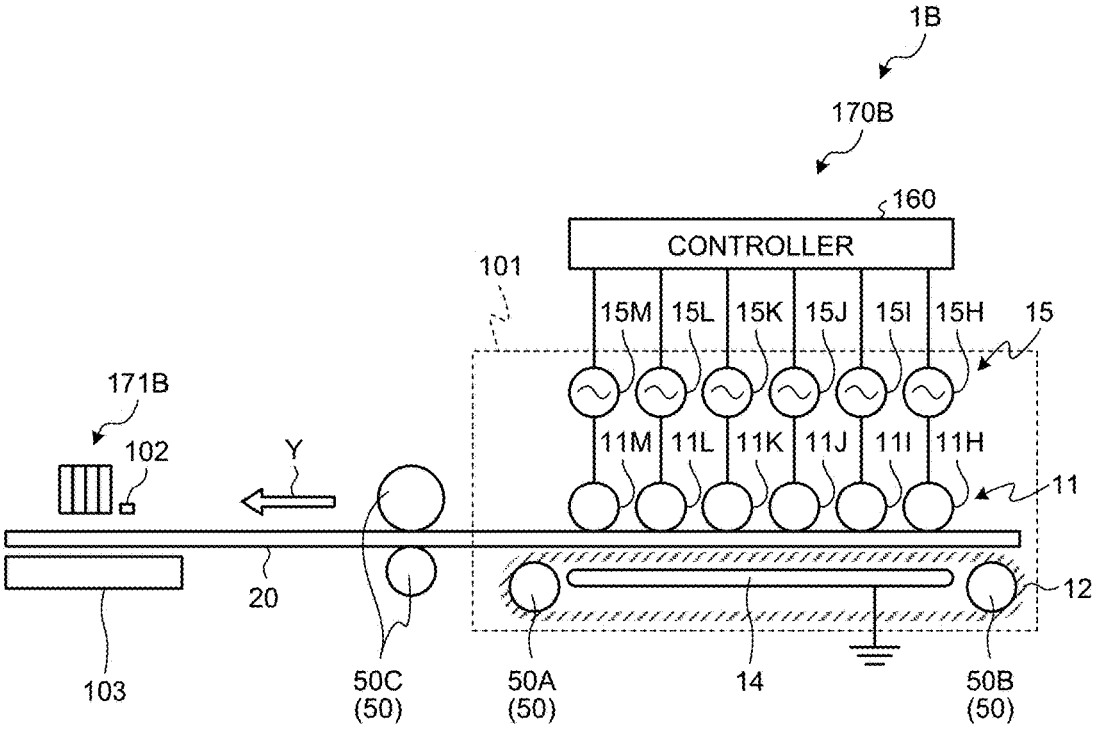
FIG. 26 is a descriptive view for explaining a printing system.

FIG. 26 is a descriptive view for explaining a printing system 1B in a second embodiment of the present invention.

The printing system 1B includes a printing apparatus 170B. The printing apparatus 170B includes the controller 160, a recording unit 171B, the plasma processor 101, the heating unit 103, and the detector 102. The controller 160, the recording unit 171B, the plasma processor 101, the heating unit 103, and the detector 102 are connected to one another so as to transmit and receive pieces of data and signals.

The plasma processor 101 includes mechanisms same as those of the plasma processing device 10 (see FIG. 1). In the example as illustrated in FIG. 26, in the plasma processor 101, a plurality of discharge electrodes 11 (11H to 11M) and the counter electrode 14 are arranged so as to oppose each other with the dielectric material 12 interposed therebetween. A plurality of high-frequency high-voltage power supplies 15 (15H to 15M) apply high-frequency high-voltage pulses to the discharge electrodes 11 and the counter electrode 14. The controller 160 controls plasma energy by adjusting the number of discharge electrodes 11 that are driven among the discharge electrodes 11 provided on the plasma processor 101, a voltage value that is applied, voltage application time, and other conditions.

In the printing apparatus 170B, the dielectric material 12 is configured into an endless belt type and functions as a conveying belt. The inner side of the dielectric material 12 is supported by a pair of conveying rollers 50 (50A and 50B). The dielectric material 12 is made to rotate by following rotation of these conveying rollers 50 so as to convey the processing target matter 20 in the conveyance direction (direction of the arrow Y). The processing target matter 20 is conveyed in the direction of the recording unit 171B from the plasma processor 101 by other conveying rollers 50 (50C) and the like.

The recording unit 171B is provided at the downstream side of the plasma processor 101 in the conveyance direction. The recording unit 171B discharges ink and records dots onto the processing target matter 20 on which the plasma processing has been performed. The recording unit 171B employs the single-pass system. It should be noted that the recording unit 171B is the same as the recording unit 171 in the first embodiment except for the inkjet recording system.

The detector 102 detects the surface temperature of the processing target matter 20 at the time of the recording of the dots. In the present embodiment, the detector 102 is provided at a position capable of detecting the surface temperature of the processing target matter 20 at the time of the recording of the dots performed by the recording unit 171B. In the present embodiment, the detector 102 is arranged in the vicinity of the recording unit 171B.

The heating unit 103 heats the ink discharge region of the processing target matter 20. In the present embodiment, the heating unit 103 is provided at a position opposing an ink discharge surface (ink discharge ports of nozzles) of the recording unit 171B with the processing target matter 20 interposed therebetween. In the present embodiment, the heating unit 103 heats the processing target matter 20 at the time of the recording of the dots by the discharge of the ink from the opposite side to the surface onto which the dots are discharged. That is to say, in the present embodiment, the heating unit 103 is arranged at a position capable of heating the processing target matter 20 at the second timing at which the dots are recorded.

In the same manner as in the first embodiment, it is sufficient that the heating unit 103 heats the processing target matter 20 at at least one timing of the first timing before the dots are recorded, the second timing at which the dots are recorded, and the third timing after the dots are recorded.

The controller 160 is the same as that in the first embodiment except that the controller 160 controls the recording unit 171B of the single-pass system instead of the recording unit 171.

Even when the single-pass system is used as the inkjet recording system, the printing apparatus 170B can provide the same effects as those in the first embodiment.

Third Embodiment

In the above-mentioned embodiments, the main body of the heating unit 103 is a device that generates heat, as an example. That is to say, the ink discharge region of the processing target matter 20 is heated by heat generated by heat generation of the main body of the heating unit 103 as an example in the above-mentioned embodiments.

In a third embodiment, instead of the heating unit 103, a heating unit that heats the ink discharge region of the processing target matter 20 by blowing out hot air toward the ink discharge region of the processing target matter 20 is used. It should be noted that the same reference numerals denote the configurations having the same functions as those in the above-mentioned embodiments and a detail description thereof is omitted.

Figure 27A:
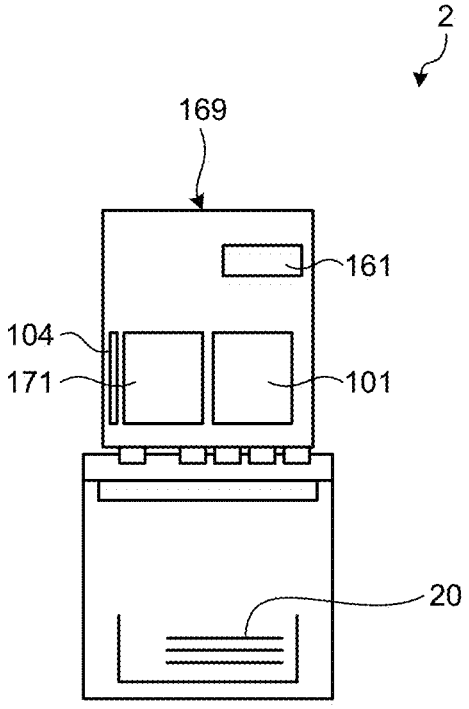
FIGS. 27A and 27B are plan views illustrating the schematic configuration of a printing system.
Figure 27B:
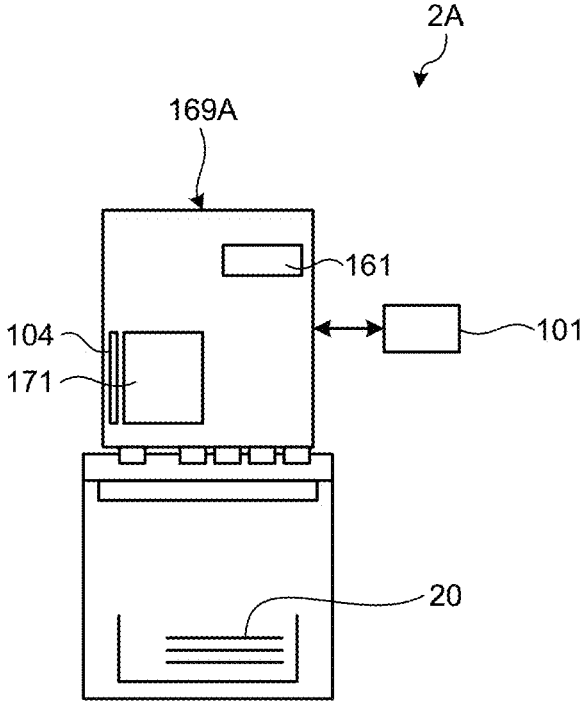

FIGS. 27A and 27B are plan views illustrating the schematic configuration of a printing system 2 in the present embodiment. As illustrated in FIG. 27A, the printing system 2 includes a printing apparatus 169. The printing apparatus 169 includes the recording unit 171, the plasma processor 101, a heating unit 104, and a controller 161.

The plasma processor 101 and the recording unit 171 are the same as those in the first embodiment. The heating unit 104 heats the ink discharge region of the processing target matter 20 by blowing out hot air toward the ink discharge region of the processing target matter 20.

The controller 161 controls the printing apparatus 169.

It is sufficient that the heating unit 104 includes a well-known mechanism of blowing out hot air and an adjusting mechanism of adjusting a temperature of hot air and a velocity of hot air. It is sufficient that a well-known device is used for the heating unit 104.

In the present embodiment, the printing apparatus 169 has a configuration including the plasma processor 101. The printing apparatus 169 and the plasma processor 101 may be configured as separate bodies, alternatively. In this case, as illustrated in FIG. 27B, it is sufficient that a printing system 2A includes a printing apparatus 169A and the plasma processor 101. The printing apparatus 169A is the same as the printing apparatus 169 except that it does not include the plasma processor 101.

Next, the schematic configuration of the printing apparatus 169 will be described with reference to FIG. 28 and FIG. 29 selectively.

In the present embodiment, the multi-pass system is employed as an inkjet recording system of the printing apparatus 169, as an example.

Figure 28:
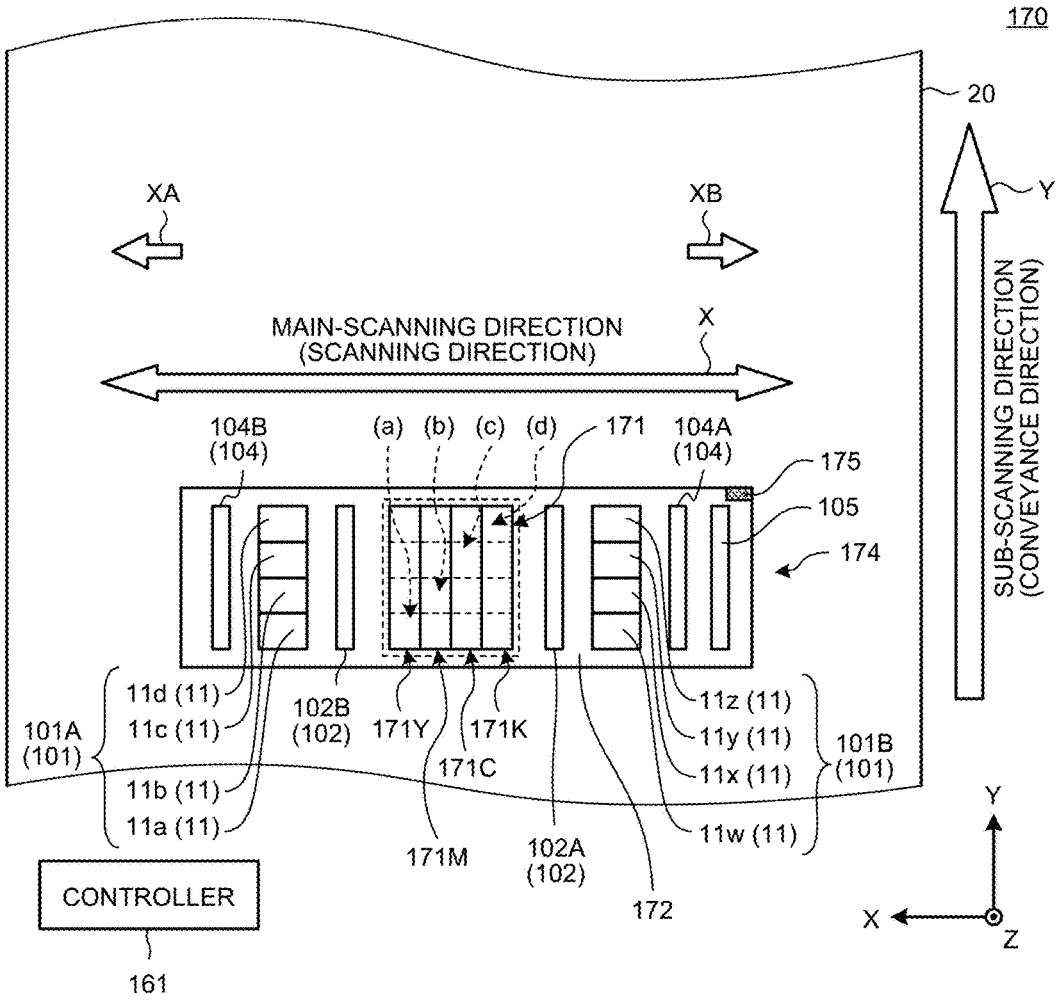
FIG. 28 is a top view illustrating the schematic configuration of a head unit.

FIG. 28 is a top view illustrating the schematic configuration of a head unit 174 of the printing apparatus 169. FIG. 29 is a side view illustrating the schematic configuration of the head unit 174 along the scanning direction (main-scanning direction, direction of an arrow X).

Figures 29, 30:
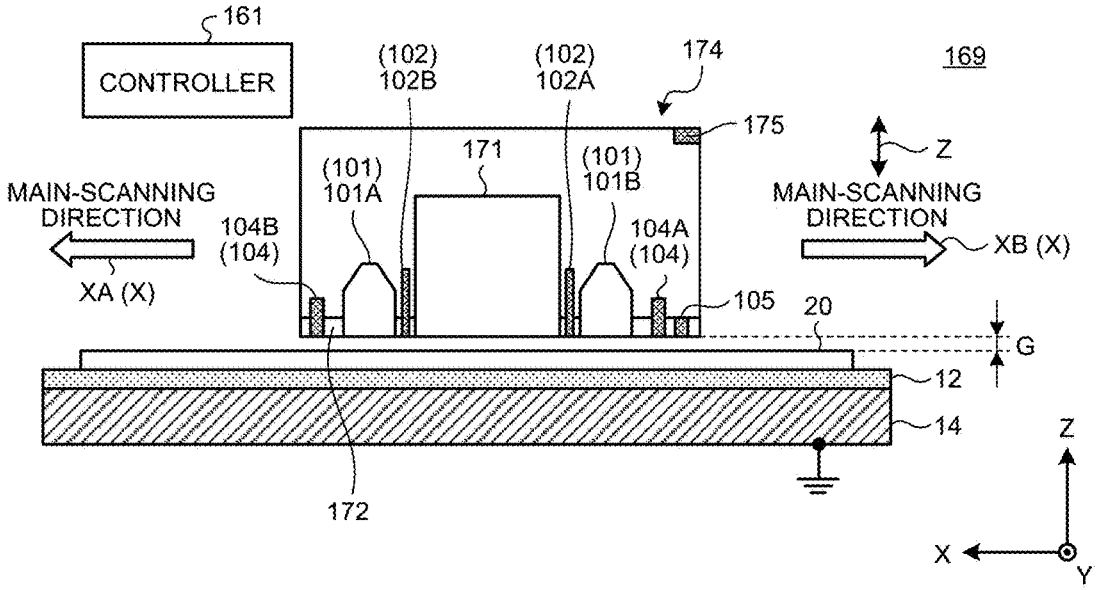
FIG. 29 is a side view illustrating the schematic configuration of the head unit.
FIG. 30 is a view illustrating evaluation results of the robustness.

As illustrated in FIG. 28 and FIG. 29, the printing apparatus 169 includes the controller 161, the recording unit 171, and the plasma processor 101. The printing apparatus 169 further includes the heating unit 104, the detector 102, a sensor 105, and a driving unit 175. The detector 102, the sensor 105, the heating unit 104, the recording unit 171, the plasma processor 101, and the driving unit 175 are electrically connected to the controller 161.

The detector 102, the recording unit 171, and the plasma processor 101 are the same as those in the first embodiment. That is to say, the printing apparatus 169 is the same as the printing apparatus 170 in the first embodiment except that it includes the heating unit 104 instead of the heating unit 103, the controller 161 instead of the controller 160, and the head unit 174 instead of the head unit 173, and additionally includes the sensor 105 and the driving unit 175.

The head unit 174 includes the plasma processor 101, the detector 102, the heating unit 104, the recording unit 171, and the sensor 105, and supports them. In the present embodiment, the carriage 172 causes the head unit 174 to reciprocate in the direction (main-scanning direction, see, direction of the arrow X) orthogonal to the conveyance direction (sub-scanning direction, direction of an arrow Y) of the processing target matter 20 by a driving mechanism (not illustrated).

The sensor 105 detects a distance (hereinafter, referred to as a gap G in some cases) between the head unit 174 and the processing target matter 20. As illustrated in FIG. 29, the gap G indicates a minimum distance between the surface of the head unit 174 that opposes the processing target matter 20 and the surface of the processing target matter 20 that opposes the head unit 174.

It is sufficient that the sensor 105 is a device capable of detecting the gap G and a well-known device can be used the sensor 105.

The driving unit 175 moves the head unit 174 in the direction (direction of an arrow Z) of being close to or separated from the processing target matter 20. It is sufficient that the driving unit 175 is a mechanism moving the head unit 174 in the direction of the arrow Z and the configuration thereof is not limited. For example, the driving unit 175 includes a housing covering the head unit 174, a supporting member supporting the housing in the horizontal direction (direction of the arrow X), and an eccentric cam for adjusting the position of the supporting member in the vertical direction (direction of the arrow Z). The driving unit 175 may be a mechanism adjusting the gap G by rotationally driving the eccentric cam and adjusting the position of the supporting member in the vertical direction (direction of the arrow Z).

The printing apparatus 169 in the present embodiment performs the plasma processing on the processing target matter 20 and heats the ink discharge region of the processing target matter 20 using the heating unit 104.

Evaluation results of robustness, bleeding, and beading when the heating unit 104 is used as the heating unit will be described.

FIG. 30 is a view illustrating evaluation results of the robustness. To be specific, FIG. 30 illustrates the evaluation results of the robustness of an image with recorded dots corresponding to plasma energy by the plasma processing and heating conditions.

The plasma processing was performed before the dot recording by the discharge of the ink. The heating time was set to be constant and only the heating conditions were adjusted. The heating conditions include the velocity of the hot air and the temperature of the hot air (hereinafter, referred to as a hot air temperature in some cases). The heating timing of the processing target matter 20 was set to a time point at which the dots were recorded with the ink.

A larger value of the evaluation result of the robustness illustrated in FIG. 30 indicates higher robustness. To be specific, the robustness is normal when the value is "3" and the robustness is preferable when the value is "5".

As illustrated in FIG. 30, as at least one of the plasma energy and the velocity and the hot air temperature defined by the heating conditions was higher, the robustness was more preferable. As both of the plasma energy and the heating temperature were higher, the robustness was more preferable.

This is because, although depending on the types of the processing target matter 20, higher plasma energy indicates larger irregularities on the surface of the ink layer (roughened), increased acidification, and a higher aggregation rate of the pigment. This is because as at least one of the velocity of the hot air and the hot air temperature is higher, the aggregation rate of the pigment is increased. In addition, as all of the plasma energy, the velocity of the hot air, and the temperature of the hot air are higher, the ink is dried in a state where the roughness of the ink layer is increased with high plasma energy.

FIG. 31 is a view illustrating evaluation results of bleeding. FIG. 31 illustrates the evaluation results of the bleeding of an image with recorded dots corresponding to the plasma energy by the plasma processing and the heating conditions. The heating conditions include the velocity of the hot air and the hot air temperature as in the evaluation illustrated in FIG. 30.

FIG. 31 illustrates the evaluation results of the bleeding that corresponds to the heating conditions and the plasma energy for each of the case where recording of moving the multi-pass recording head by 6 passes (that is, 6 scans) was performed and the heating time was set to the period of time for 6 passes and the case where recording of moving the multi-pass recording head by 3 passes was performed and the heating time was set to the period of time for 3 passes. The heating timing of the processing target matter 20 was set to a time point at which the dots were recorded with the ink.

A larger value of the evaluation result of bleeding illustrated in FIG. 31 indicates a more preferable evaluation result. To be specific, the evaluation result is not preferable when the value is equal to or lower than "2" and the evaluation result is preferable when the value is "5".

As illustrated in FIG. 31, as at least one of the plasma energy, the velocity of the hot air, and the hot air temperature was higher, the evaluation result of bleeding was more preferable. As all of the plasma energy, the velocity of the hot air, and the hot air temperature were higher, the evaluation result of bleeding was more preferable. It has been found that even in the recording by 3 passes with a high printing speed, the value "5" indicating a preferable evaluation result of bleeding can be provided by adjusting the heating conditions and the plasma energy as in the recording by 6 passes with a low printing speed.

FIG. 32 is a view illustrating evaluation results of beading. FIG. 32 illustrates the evaluation results of the beading of an image with recorded dots corresponding to the plasma energy by the plasma processing and the heating conditions. The heating conditions include the velocity of the hot air and the hot air temperature as in the evaluation illustrated in FIG. 30.

FIG. 32 illustrates the evaluation results of the beading that corresponds to the heating conditions and the plasma energy for each of the case where recording of moving the multi-pass recording head by 6 passes (that is, 6 scans) was performed and the heating time was set to the period of time for 6 passes and the case where recording of moving the multi-pass recording head by 3 passes was performed and the heating time was set to the period of time for 3 passes. The heating timing of the processing target matter 20 was set to a time point at which the dots were recorded with the ink.

A larger value of the evaluation result of beading illustrated in FIG. 32 indicates a more preferable evaluation result. To be specific, the evaluation result is not preferable when the value is equal to or lower than "2" and the evaluation result is preferable when the value is "5".

As illustrated in FIG. 32, as at least one of the plasma energy, the velocity of the hot air, and the hot air temperature was higher, the evaluation result of beading was more preferable. As all of the plasma energy, the velocity of the hot air, and the hot air temperature were higher, the evaluation result of beading was more preferable. It has been found that even in the recording by 3 passes with a high printing speed, the value "5" indicating a preferable evaluation result of beading can be provided by adjusting the heating conditions and the plasma energy as in the recording by 6 passes with a low printing speed.

The inventors have found, from the above-mentioned evaluation results, that deterioration in image quality can be reduced by combining the plasma processing on the processing target matter 20 and the velocity of the hot air and the hot air temperature as the heating conditions of the ink discharge region of the processing target matter 20. Furthermore, the inventors have found that this combined configuration can reduce the deterioration in image quality even when the printing speed is increased.

The inventors have found that the deterioration in image quality can be reduced by decreasing the velocity of the hot air as low as possible and adjusting the hot air temperature when adjustment is made so as to provide certain heating conditions.

That is to say, the inventors have found that the deterioration in image quality can be reduced by increasing the plasma energy and the hot air temperature although beading or bleeding is more likely to occur at a lower velocity of the hot air. This is because lowering of aggregation performance of the pigment can be reduced.

The inventors have found that both of the reduction in the deterioration in image quality and energy saving can be achieved by lowering any one of the plasma energy and the hot air temperature when the velocity of the hot air is high.

FIGS. 33A and 33B are views illustrating an example of an evaluation result when the hot air temperature by the heating unit 104 was set to be constant and the velocity of the hot air was set to be variable.

FIG. 33A is an image when the velocity of the hot air was high and FIG. 33B is an image when the velocity of the hot air was low. As illustrated in FIGS. 33A and 33B, in the case where the hot air temperature was constant, when the velocity of the hot air was low (see FIG. 33B), the deterioration in image quality was reduced in comparison with that when the velocity of the hot air is high (see FIG. 33A).

The inventors have found that the plasma energy by the plasma processing on the processing target matter 20 and the heating energy are preferably adjusted in accordance with the gap G between the head unit 174 and the processing target matter 20.

As the gap G between the head unit 174 and the processing target matter 20 is larger, a distance to the processing target matter 20 for the ink discharged from the recording unit 171 is increased. Due to the increased distance, before the ink discharged from the recording unit 171 reaches the processing target matter 20, deviation of landing positions of the ink and variation in the landing positions on the processing target matter 20 can occur with the hot air by the heating unit 104.

The inventors have found that the deterioration in image quality can be reduced by decreasing the velocity of the hot air by the heating unit 104 and increasing at least one of the hot air temperature and the plasma energy as the gap G is larger.

FIG. 34 is a view illustrating evaluation results of image quality. FIG. 34 illustrates the evaluation results of the image quality of an image with recorded dots corresponding to the plasma energy by the plasma processing and the heating conditions. The heating conditions include the velocity of the hot air and the hot air temperature as in the evaluation illustrated in FIG. 30.

FIG. 34 illustrates the evaluation results of the image quality that corresponds to the heating conditions and the plasma energy for each of the case where the gap G was 1.8 mm and the case where the gap G was 2.8 mm. The heating timing of the processing target matter 20 was set to a time point at which the dots were recorded with the ink.

A larger value of the evaluation result of the image quality illustrated in FIG. 34 indicates a more preferable evaluation result. To be specific, the evaluation result is not preferable when the value is equal to or lower than "2" and the evaluation result is preferable when the value is "5".

As illustrated in FIG. 34, when the plasma energy and the hot air temperature were constant, the image quality was improved as the velocity was lower and the image quality was improved as the gap G was smaller.

When the plasma energy and the velocity of the hot air were constant, the image quality was deteriorated as the hot air temperature was higher in some cases. This is because increase in the ink temperature in a liquid chamber of the recording unit 171 with the hot air from the heating unit 104 increases a dissolved oxygen amount of the ink in the liquid chamber of the recording unit 171 and air bubbles are formed therein. When the air bubbles are formed in the liquid chamber of the recording unit 171, flying astray of the ink that is discharged from the recording unit 171 can occur. The image quality was, however, improved by increasing the plasma energy even when the hot air temperature was high, as illustrated in FIG. 34.

The inventors have found, from the above-mentioned evaluation results, that the deterioration in image quality can be reduced by adjusting the plasma processing on the processing target matter 20, the velocity of the hot air and the hot air temperature as the heating conditions of the ink discharge region of the processing target matter 20, and the gap G.

The inventors have found that predetermined targets dots satisfying at least one of the predetermined diameter, the predetermined shape, and the predetermined density distribution (aggregation degree of the pigment) can be recorded by adjusting the plasma energy of the plasma processing on the processing target matter 20 and the heating energy as described in the first embodiment.

The inventors have found that the plasma energy and the heating energy necessary for recording the predetermined target dots are different depending on the types of the processing target matter 20, the amount of the ink (e.g., in large droplets, middle droplets, or small droplets), the types of the ink, and the printing modes as described in the first embodiment.

The controller 161 of the printing apparatus 169 controls at least one of the plasma energy by the plasma processor and the heating energy by the heating unit 104 such that the predetermined dots are recorded on the processing target matter 20.

In the present embodiment, the controller 161 controls the heating energy by the heating unit 104 by controlling at least one of the temperature of the hot air, the velocity of the hot air, and the heating time.

The controller 161 preferably controls at least one of the plasma energy by the plasma processor 101 and the heating energy by the heating unit 104 in accordance with at least one of the type of the processing target matter 20, the ink amount, the ink type, the printing mode, the gap G detected by the sensor 105, and the surface temperature of the processing target matter 20 that has been detected by the detector 102.

Figure 35:
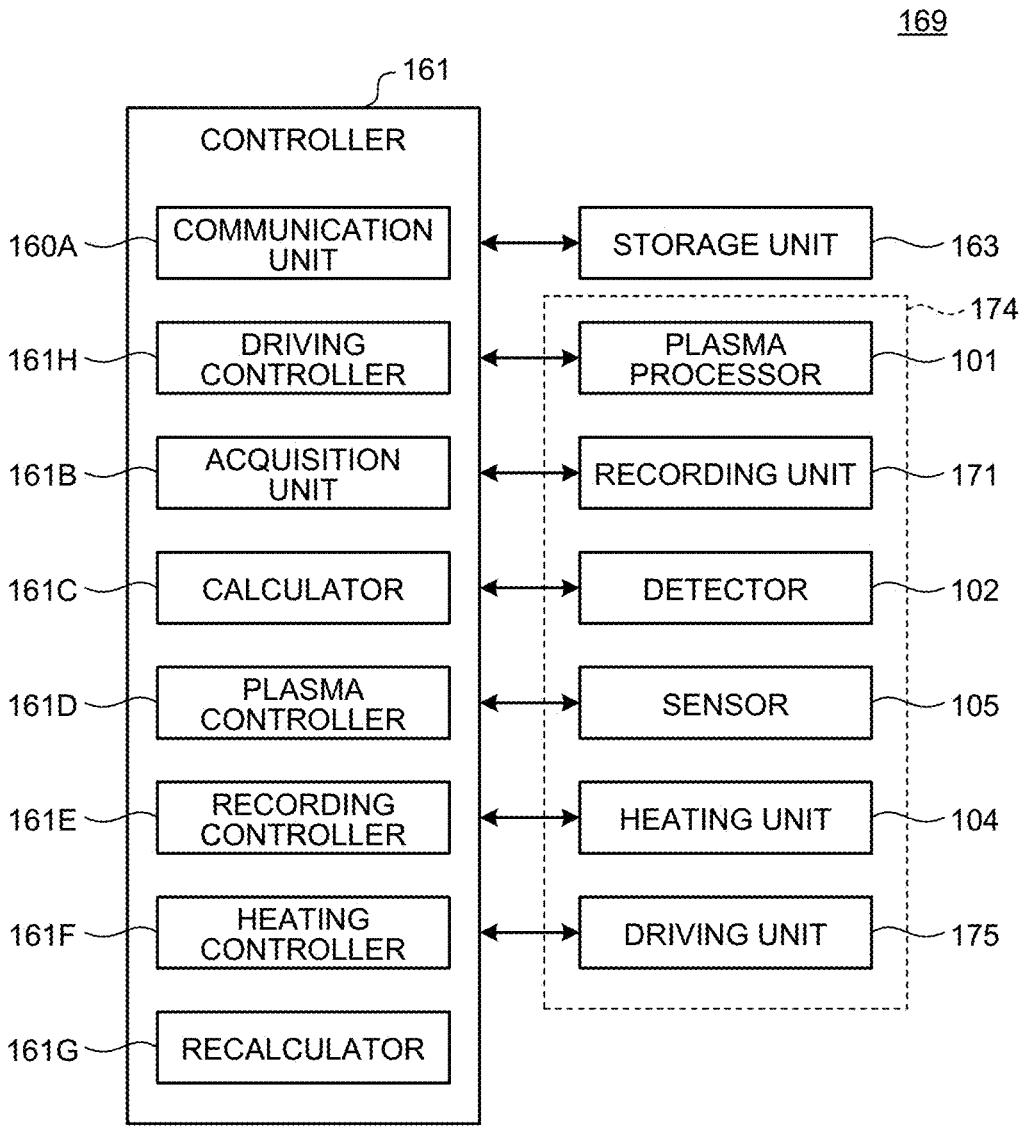
FIG. 35 is a functional block diagram illustrating a printing apparatus.

FIG. 35 is a functional block diagram of the printing apparatus 169.

The printing apparatus 169 includes the controller 161, a storage unit 163, the plasma processor 101, the recording unit 171, the detector 102, the heating unit 104, the sensor 105, and the driving unit 175. The controller 161, the storage unit 163, the plasma processor 101, the recording unit 171, the detector 102, the heating unit 104, the sensor 105, and the driving unit 175 are connected to one another so as to transmit and receive pieces of data and signals. As described above, the plasma processor 101, the recording unit 171, the detector 102, the heating unit 104, the sensor 105, and the driving unit 175 configure the head unit 174. The storage unit 163 stores therein pieces of data of various types.

The controller 161 is a computer configured by including the CPU and the like and controls the entire printing apparatus 169. It should be noted that the controller 161 may be configured by circuitry or the like other than the CPU.

The controller 161 includes the communication unit 160A, an acquisition unit 161B, a calculator 161C, a plasma controller 161D, a recording controller 161E, a heating controller 161F, a recalculator 161G, and a driving controller 161H. Some or all of the communication unit 160A, the acquisition unit 161B, the calculator 161C, the plasma controller 161D, the recording controller 161E, the heating controller 161F, the recalculator 161G, and the driving controller 161H may be made to function by causing a processing device such as the CPU to execute a computer program, that is, by software, by hardware such as an IC, or by software and hardware in combination.

The communication unit 160A communicates with an external device (not illustrated), for example, through the Internet or other network. The communication unit 160A is the same as that in the first embodiment and receives print data from the external device.

The driving controller 161H controls the driving unit 175 so as to adjust the gap G in accordance with the type of the processing target matter 20 as an image formation target.

For example, the storage unit 163 previously stores therein the types of the processing target matter 20 and the preferable gaps G when an image is formed on the processing target matters 20 of the respective types in a manner corresponding to each other. There are the processing target matter 20 having irregularities on the surface thereof, the processing target matter 20 having poor planarity, and the processing target matter 20 having a large thickness as the types of the processing target matter 20. It is sufficient that the storage unit 163 previously stores therein, as the gap G, a distance with which the surface of the processing target matter 20 and the ink discharge surface by the recording unit 171 do not make contact with each other at the time of the recording of the dots and the ink is preferably discharged so as to form an image for each type of the processing target matter 20.

For example, the driving controller 161H reads the setting information contained in the print data so as to acquire the type of the processing target matter 20. The driving controller 161H reads the gap G corresponding to the read type from the storage unit 163. Furthermore, the driving controller 161H controls the driving of the driving unit 175 until the gap detected by the sensor 105 is identical to the read gap G. The driving unit 175 drives the head unit 174 under the control of the driving controller 161H, so that the distance between the head unit 174 and the processing target matter 20 can be adjusted to be the read gap G.

The acquisition unit 161B acquires the printing mode, the type of the processing target matter 20, the type of the ink that is discharged onto the processing target matter 20, the amount of the ink that is discharged onto the processing target matter 20, and the gap between the head unit 174 and the processing target matter 20.

The acquisition unit 161B reads the gap G corresponding to the type of the processing target matter 20 that has been used for adjustment by the driving controller 161H from the storage unit 163 so as to acquire the gap G. It should be noted that the acquisition unit 161B may acquire the gap G by reading the gap G detected by the sensor 105.

It is sufficient that the acquisition unit 161B acquires the printing mode, the type of the processing target matter 20, the type of the ink that is discharged onto the processing target matter 20, and the amount of the ink that is discharged onto the processing target matter 20 in the same manner as the acquisition unit 160B described in the first embodiment.

The calculator 161C calculates the plasma energy by the plasma processor 101 and the heating energy by the heating unit 104 that are used for recording the predetermined dots on the processing target matter 20. In the present embodiment, the calculator 161C calculates the velocity of the hot air and the hot air temperature by the heating unit 104 as the heating energy.

The calculator 161C may set one of the plasma energy and the heating energy to be a constant value and set the other of them to be variable and calculate the other one. Alternatively, the calculator 161C may set both of the plasma energy and the heating energy to be variable and calculate both of them.

The calculator 161C may set one or two of the plasma energy, the velocity of the hot air, and the hot air temperature to be constant and set other two or one element(s) to be variable and calculate variable values (the plasma energy, the velocity, and/or the hot air temperature). The calculator 161C may set all of the plasma energy, the velocity of the hot air, and the hot air temperature to be variable and calculate all of the values thereof.

In the present embodiment, the calculator 161C calculates the plasma energy and the heating energy for recording the predetermined dots on the processing target matter 20 in accordance with at least one of the printing mode, the type of the processing target matter 20, the amount of the ink that is discharged onto the processing target matter 20, the type of the ink that is discharged onto the processing target matter 20, the gap G, and the surface temperature of the processing target matter 20 that has been detected by the detector 102.

For example, the storage unit 163 previously stores therein the plasma energy and the heating energy for recording the predetermined dots in a manner corresponding to the printing mode, the type of the processing target matter 20, the type of the ink discharged onto the processing target matter 20, the amount of the ink that is discharged, and the gap G.

The calculator 161C reads the plasma energy and the heating energy corresponding to the printing mode, the type of the processing target matter 20, the type of the ink that is discharged onto the processing target matter 20, the amount of the ink that is discharged, and the gap G, which have been acquired by the acquisition unit 161B, from the storage unit 163. It is sufficient that the calculator 161C calculates the plasma energy and the heating energy for recording the predetermined dots by this reading.

It is sufficient that the user uses the printing apparatus 169 to previously measure the plasma energy and the heating energy for causing the predetermined target dots to be recorded using the printing modes of a plurality of types, the processing target matters 20 of a plurality of types, the inks of a plurality of types, the amounts of the ink of a plurality of types, and the gaps G of a plurality of types. Furthermore, it is sufficient that the controller 161 performs control to previously store, in the storage unit 163, the measured conditions (combination of the printing mode, the type of the processing target matter 20, the type of the ink, the amount of the ink, and the gap G) and the plasma energy and the heating energy for recording the predetermined target dots (dots having the target shape, diameter, and density distribution) corresponding to each other.

For example, it is sufficient that the controller 160 performs control to form an image on the processing target matter 20 while varying the conditions (combination of the printing mode, the type of the processing target matter 20, the type of the ink, the amount of the ink, and the gap G) and to store, in the storage unit 163, the plasma energy and the heating energy with which preferable target dots are formed as the plasma energy and the heating energy corresponding to the conditions.

When a plurality of preferable evaluation results are provided, any combination of the heating energy and the plasma energy may be stored in the storage unit 163. It is, however, preferable that among the preferable evaluation results, a combination of the plasma energy and the heating energy at least one of which is lower be stored in the storage unit 163 in terms of improvement in productivity and reduction in energy consumption.

To be specific, it is assumed that the evaluation results as illustrated in FIG. 34 are provided. In this case, it is sufficient that the plasma energy and the heating energy (defined by the velocity of the hot air and the hot air temperature by the heating unit 104) corresponding to the value "5" indicating a preferable evaluation result are stored in the storage unit 163 as the plasma energy and the heating energy corresponding to the measurement conditions (the printing mode, the type of the processing target matter 20, the type of the ink, the amount of the ink, and the gap G) with which the evaluation result was provided.

To be more specific, for example, when the ink amount is small (for example, small droplets), a lower velocity of the hot air is preferably stored, whereas when the ink amount is large (for example, large droplets), larger plasma energy is preferably stored.

When the velocity of the hot air is high in the case where the ink amount is small, deterioration in image quality can occur due to scattering of the ink and deviation of landing positions thereof in some cases. When printing is performed while priority is given to the speed, an image having a lowered resolution (for example, an image having a resolution lowered to 600 dpi from 1200 dpi) is printed. Due to this, the deterioration in image quality due to the lowered density can occur in some cases unless the ink amount that is discharged is increased and the dot diameter is increased. In this case, when the ink amount is simply increased, bleeding is generated to cause blur on the boundaries. Conventionally, the deterioration in image quality due to the lowered density can occur in some cases.

In the present embodiment, for example, it is sufficient that the plasma energy and the heating energy (defined by the velocity of the hot air and the hot air temperature by the heating unit 104) corresponding to a value (for example, "5") indicating a preferable evaluation result are stored in the storage unit 163 as the plasma energy and the heating energy corresponding to the measurement conditions (the printing mode, the type of the processing target matter 20, the type of the ink, the amount of the ink, and the gap G) when the evaluation result has been provided.

It is sufficient that the calculator 161C reads the plasma energy and the heating energy corresponding to the printing mode, the type of the processing target matter 20, the type of the ink that is discharged onto the processing target matter 20, the amount of the ink that is discharged, and the gap G acquired by the acquisition unit 161B from the storage unit 163, so as to calculate the plasma energy and the heating energy for recording the predetermined dots.

Accordingly, the image density can be improved with a smaller ink amount, for example, and the deterioration in image quality can also be reduced.

When a plurality of preferable evaluation results (for example, the value "5" indicating a preferable evaluation result) are provided, any combination of the heating energy and the plasma energy may be stored in the storage unit 163. It is, however, preferable that among the preferable evaluation results, a combination of the plasma energy and the heating energy at least one of which is lower be stored in the storage unit 163 in terms of improvement in productivity and reduction in energy consumption.

When the velocity of the hot air or the hot air temperature by the heating unit 104 is excessively high, discharge failure due to the drying of the nozzles occurs in some cases. Furthermore, as the printing speed is higher, the plasma energy by the plasma processor 101 is required to be increased. In order to avoid these disadvantages, the plasma energy and the heating energy when the preferable evaluation result is provided in a state where the plasma energy is lower and the heating conditions (the velocity of the hot air and the hot air temperature) are set in a range causing no discharge failure of the nozzles are preferably specified and stored in the storage unit 163.

The plasma controller 161D controls the plasma processor 101 so as to perform the plasma processing on the surface of the processing target matter 20 with the plasma energy calculated by the calculator 161C. It is sufficient that the control of the plasma processor 101 by the plasma controller 161D is performed in the same manner as the plasma controller 160D described in the first embodiment.

The heating controller 161F controls the heating unit 104 so as to heat at least the ink discharge region of the processing target matter 20 with the heating energy calculated by the calculator 161C.

For example, the heating controller 161F controls the heating unit 104 so as to provide the velocity of the hot air and the hot air temperature that are indicated by the heating energy calculated by the controller 161. With this, the heating controller 161F controls the heating unit 104 so as to heat at least the ink discharge region of the processing target matter 20 with the calculated heating energy.

Thus, the controller 161 controls at least one of the plasma energy by the plasma processor 101 and the heating energy by the heating unit 104 such that the predetermined dots are recorded on the processing target matter 20.

The recalculator 161G recalculates at least one of the plasma energy and the heating energy for recording the predetermined dots on the processing target matter 20 in accordance with the surface temperature acquired from the detector 102 in the same manner as the recalculator 160G (see FIG. 24).

In the present embodiment, the recalculator 161G recalculates the plasma energy and the heating energy calculated by the calculator 161C in accordance with the acquired surface temperature. It is sufficient that the calculation of the plasma energy and the recalculation of the heating energy are performed in the same manner as the above-mentioned calculator 161C except that calculation in accordance with the surface temperature.

To be specific, it is assumed that the acquired surface temperature is lower than the target temperature for the heating unit 104. The target temperature for the heating unit 104 is the hot air temperature that is indicated by the heating energy calculated by the calculator 161C. In other words, the target temperature for the heating unit 104 is a hot air temperature by the heating unit 104 that is currently controlled by the heating controller 161F.

Thus, when the acquired surface temperature is lower than the target temperature, the recalculator 161G sets the heating energy to be constant at the heating energy that is currently given by the heating unit 104. The recalculator 164G calculates the plasma energy higher than the plasma energy that is currently given by the plasma processor 101. For example, as the detected surface temperature is lower than the target temperature, the calculator 161G recalculates a value obtained by multiplying the plasma energy that is currently given by the plasma processor 101 by a larger factor (value larger than 1), as new plasma energy.

When the acquired surface temperature is identical to the target temperature, the recalculator 164G does not recalculate the plasma energy and the heating energy.

When the acquired surface temperature is higher than the target temperature, it is sufficient that the recalculator 161G recalculates the plasma energy and the heating energy so as to provide at least one of the plasma energy lower than the plasma energy that is currently given and the heating energy lower than the heating energy that is currently given.

When the recalculator 161G recalculates the plasma energy, the plasma controller 161D controls the plasma processor 101 so as to perform the plasma processing with the recalculated plasma energy. When the recalculator 161G recalculates the heating energy, the heating controller 161F controls the heating unit 104 so as to use the recalculated heating energy for heating.

The controller 161 therefore controls at least one of the plasma energy by the plasma processor 101 and the heating energy by the heating unit 104 such that the predetermined dots are formed on the processing target matter 20 in accordance with the detected surface temperature. When the detected surface temperature is lower than the target temperature for the heating unit 104, the controller 161 performs control to increase at least one of the plasma energy and the heating energy.

Figure 36:
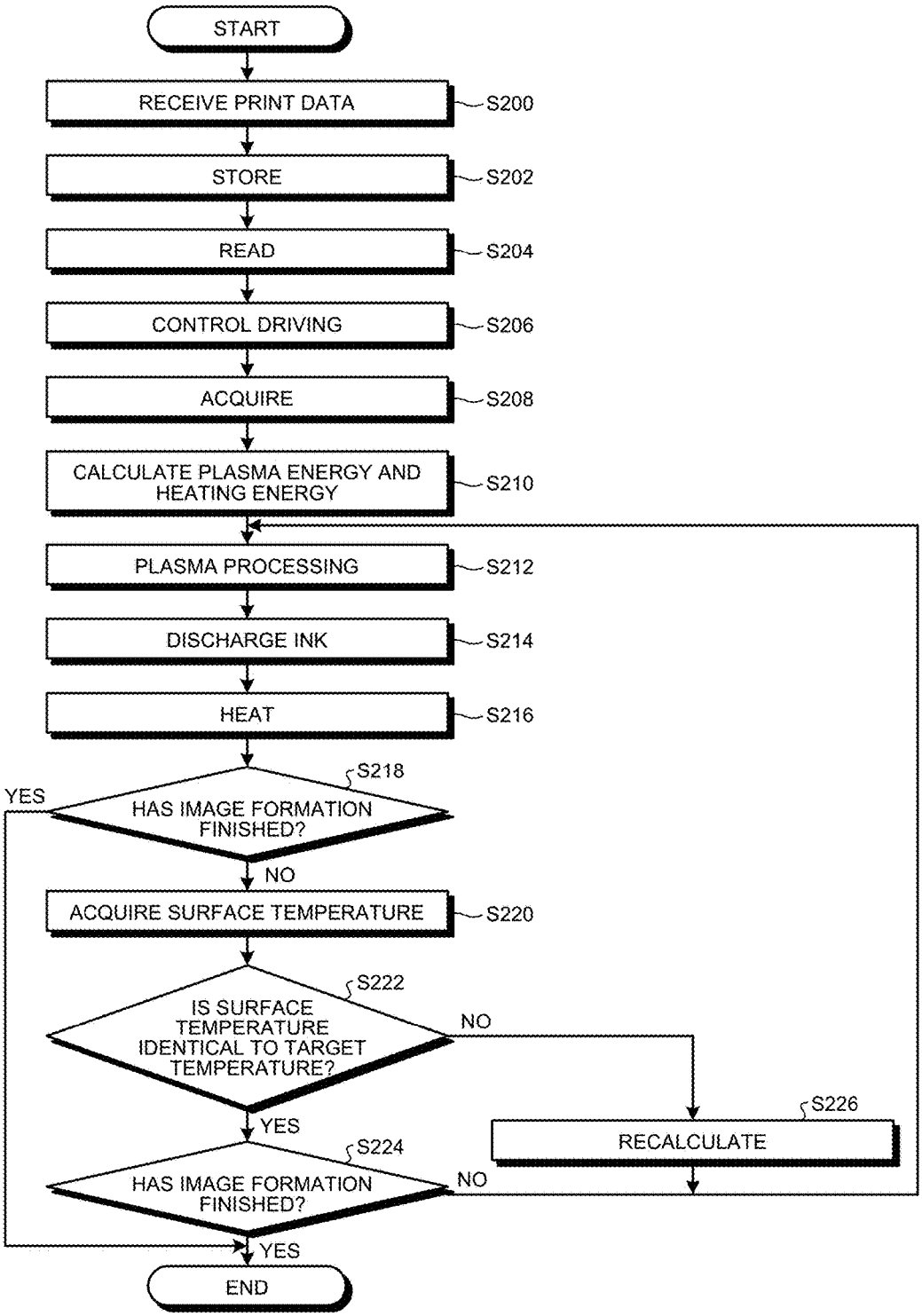
FIG. 36 is a flowchart illustrating a procedure for printing processing.

Next, a procedure for the printing processing that is executed by the printing apparatus 170 will be described. FIG. 36 is a flowchart illustrating the procedure for the printing processing that is executed by the printing apparatus 169.

First, the communication unit 160A receives print data from the external device (step S200). Then, the communication unit 160A stores the received print data in the storage unit 163 (step S202).

The driving controller 161H reads the type of the processing target matter 20 as a printing target (step S204). The driving controller 161H controls the driving of the driving unit 175 until the gap G detected by the sensor 105 is identical to the gap G read at step S204 (step S206). The driving unit 175 drives the head unit 174 by control at step S206, so that the distance between the head unit 174 and the processing target matter 20 is adjusted to the gap G read at step S204.

Subsequently, the acquisition unit 161B acquires the printing mode, the type of the processing target matter 20, the type of the ink that is discharged onto the processing target matter 20, the amount of the ink that is discharged onto the processing target matter 20, and the gap G between the head unit 174 and the processing target matter 20 (step S208).

The calculator 161C calculates the plasma energy and the heating energy for recording the predetermined dots on the processing target matter 20 in accordance with the printing mode, the type of the processing target matter 20, the amount of the ink, the type of the ink, and the gap G acquired at step S208 (step S210). At step S210, the calculator 161C calculates the velocity of the hot air and the hot air temperature by the heating unit 104 as the heating energy.

Thereafter, the plasma controller 161D controls the plasma processor 101 so as to perform the plasma processing on the surface of the processing target matter 20 with the plasma energy calculated at step S106 (step S212).

The recording controller 161E controls the recording unit 171 so as to discharge the ink in accordance with pixel values of pixels and resolution indicated by the image data contained in the print data received at step S200 (step S214).

The heating controller 161F controls the heating unit 104 so as to heat at least the ink discharge region of the processing target matter 20 with the heating energy calculated at step S210 (step S216). The processing at step S216 causes the ink discharge region of the processing target matter 20 to be heated with the hot air with the volume and the temperature controlled by the heating controller 161F that is brown out from the heating unit 104.

In the pieces of processing at step S212 to step S216, the controller 161 controls scanning of the head unit 174 and the conveyance of the processing target matter 20.

Subsequently, the controller 161 determines whether an image of the image data contained in the print data has been formed (step S218). When positive determination is made at step S218 (Yes at step S218), this routine is finished.

When negative determination is made at step S218 (No at step S218), the process proceeds to step S220.

At step S220, the recalculator 161G acquires the surface temperature of the processing target matter 20 from the detector 102 (step S220). Then, the recalculator 161G determines whether the acquired surface temperature is identical to the target temperature (step S222). When the acquired surface temperature is not identical to the target temperature (No at step S222), the process proceeds to step S226. At step S226, the recalculator 161G recalculates the plasma energy and the heating energy using the surface temperature acquired at step S220 (step S226). Then, the process returns to step S212.

When the pieces of processing at step S212 and step S216 are executed after the recalculation at step S226, it is sufficient that the plasma controller 161D controls the plasma processor 101 so as to perform the plasma processing with the recalculated plasma energy at step S212. It is sufficient that the heating controller 161F controls the heating unit 104 so as to use the recalculated heating energy at step S216 for heating.

On the other hand, in the determination at step S222, when the acquired surface temperature and the target temperature are identical (Yes at step S222), the process proceeds to step S224. At step S224, the controller 161 determines whether an image of the image data contained in the print data has been formed (step S224). When negative determination is made at step S224 (No at step S224), the process returns to step S212. When positive determination is made at step S224 (Yes at step S224), this routine is finished.

As described above, the printing apparatus 169 in the present embodiment includes the plasma processor 101, the recording unit 171, and the heating unit 104. The plasma processor 101 performs the plasma processing on the processing target matter 20. The recording unit 171 discharges the ink and records the dots onto the processing target matter 20 on which the plasma processing has been performed. The heating unit 104 heats the ink discharge region of the processing target matter 20. In the present embodiment, the heating unit 104 heats the ink discharge region of the processing target matter 20 by blowing out hot air toward the ink discharge region of the processing target matter 20.

Thus, even when the heating unit 104 that heats the ink discharge region of the processing target matter 20 by blowing out hot air toward the ink discharge region of the processing target matter 20 is used as the heating unit, the controller 161 can reduce deterioration in image quality in the same manner as the printing apparatus 170 in the first embodiment.

In this case, the controller 161 can control the heating energy by the heating unit 104 by controlling the temperature of the hot air, the velocity of the hot air, and the heating time.

The printing apparatus 169 in the present embodiment includes the head unit 174 supporting the plasma processor 101, the recording unit 171, and the heating unit 104. The printing apparatus 169 includes the driving unit 175 and the sensor 105. The driving unit 175 moves the head unit 174 in the direction of being close to or separated from the processing target matter 20. The sensor 105 detects the distance (gap G) between the head unit 174 and the processing target matter 20. In this case, the controller 161 can control at least one of the plasma energy by the plasma processor 101 and the heating energy by the heating unit 104 such that the predetermined dots are formed on the processing target matter 20 in accordance with at least one of the detected distance (gap G) and the surface temperature detected by the heating unit 104.

Fourth Embodiment

In the above-mentioned third embodiment, the printing apparatus 169 employs the multi-pass system as the inkjet recording system. The inkjet recording system by the printing apparatus 169 is not limited to the multi-pass system and may be a single-pass system, for example.

Figure 37:
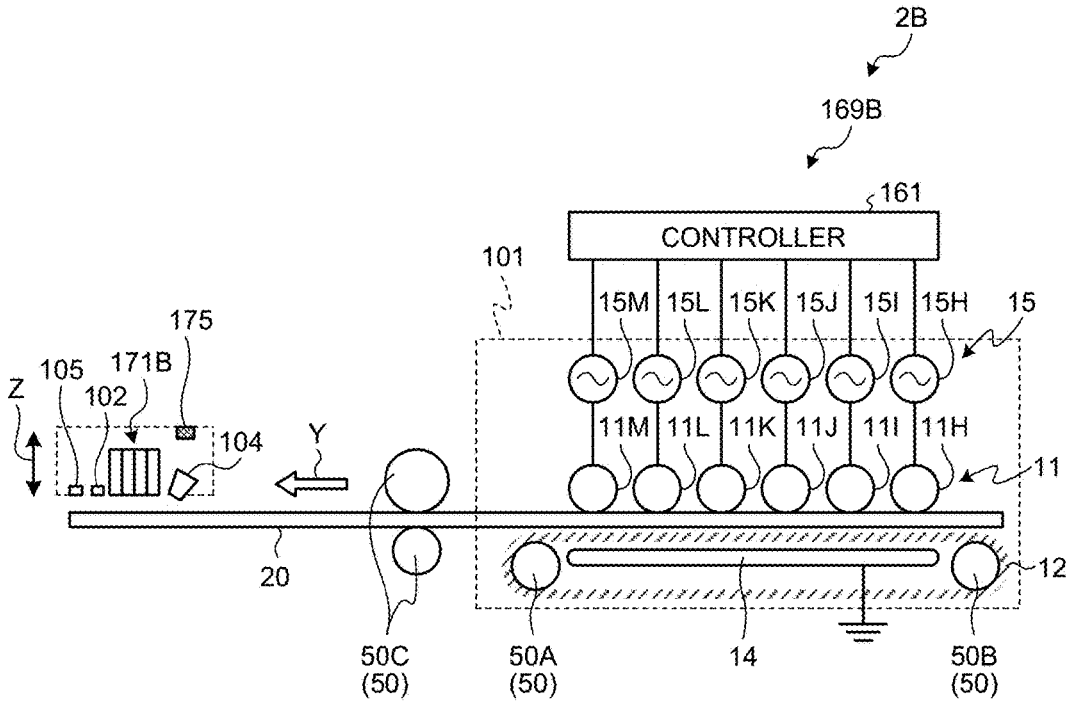
FIG. 37 is a descriptive view for explaining a printing system in an embodiment.

FIG. 37 is a descriptive view for explaining a printing system 2B in a fourth embodiment.

The printing system 2B includes a printing apparatus 169B. The printing apparatus 169B includes the controller 161, the recording unit 171B, the plasma processor 101, the heating unit 104, the detector 102, the sensor 105, and the driving unit 175. The controller 161, the recording unit 171B, the plasma processor 101, the heating unit 104, the detector 102, the sensor 105, and the driving unit 175 are connected to one another so as to transmit and receive pieces of data and signals.

The plasma processor 101 is the same as the plasma processor 101 as illustrated in FIG. 26. The recording unit 171B is provided at the downstream side of the plasma processor 101 in the conveyance direction. The recording unit 171B is the same as the recording unit 171B as illustrated in FIG. 26.

The detector 102 detects the surface temperature of the processing target matter 20 at the time of recording of dots. In the present embodiment, the detector 102 is provided at a position capable of detecting the surface temperature of the processing target matter 20 at the time of the recording of the dots performed by the recording unit 171B. In the present embodiment, the detector 102 is arranged in the vicinity of the recording unit 171B.

The heating unit 104 heats the ink discharge region of the processing target matter 20. In the present embodiment, the heating unit 104 is arranged at a position capable of blowing out hot air toward the ink discharge region of the processing target matter 20. That is to say, in the present embodiment, the heating unit 104 is arranged at a position capable of heating the processing target matter 20 at the second timing at which the dots are recorded.

In the same manner as in the first embodiment, it is sufficient that the heating unit 104 heats the processing target matter 20 at at least one timing of the first timing before the dots are recorded, the second timing at which the dots are recorded, and the third timing after the dots are recorded.

The controller 161 is the same as that in the second embodiment except that the controller 161 controls the recording unit 171B of the single-pass system instead of the recording unit 171. With this configuration, even when the single-pass system is used as the inkjet recording system, the printing apparatus 169B can provide the same effects as those in the third embodiment.

Next, the hardware configurations of the above-mentioned printing apparatuses 170, 170A, 170B, 169, 169A, and 169B, and the plasma processor 101 will be described.

Figure 38:
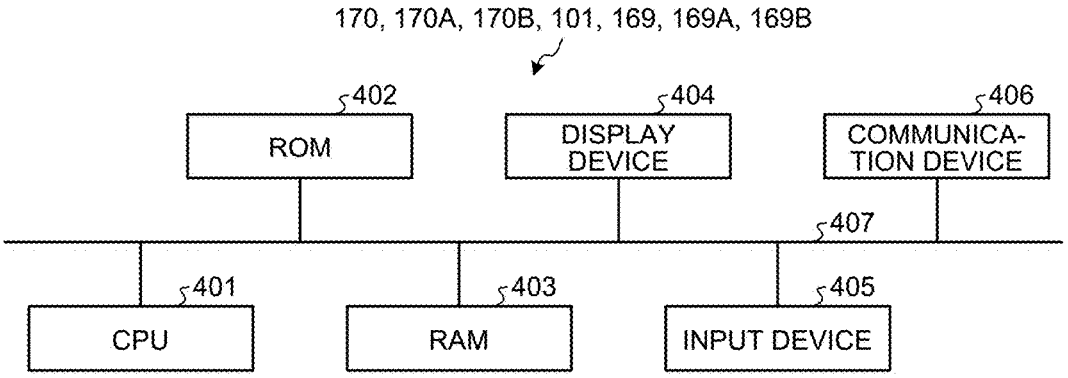
FIG. 38 is a diagram illustrating the hardware configuration of the printing apparatus.

FIG. 38 is a diagram illustrating the hardware configuration of the printing apparatuses 170, 170A, 170B, 169, 169A, and 169B, and the plasma processor 101. When the printing apparatus 170A and the plasma processor 101 are configured as the separate bodies as illustrated in FIG. 20B, the hardware configuration illustrated in FIG. 38 is also applied to the plasma processor 101.

The printing apparatuses 170, 170A, 170B, 169, 169A, and 169B, and the plasma processor 101 have the hardware configuration using a common computer in which a CPU 401 controlling the entire apparatus, a read only memory (ROM) 402 storing therein pieces of data of various types and computer programs of various types, a random access memory (RAM) 403 storing therein pieces of data of various types and computer programs of various types, an input device 405 such as a keyboard and a mouse, a display device 404 such as a display, and a communication device 406 are connected through a bus 407.

The computer programs that are executed by the printing apparatus 170, 170A, 170B, 169, 169A, or 169B, or the plasma processor 101 in the above-mentioned embodiment are recorded and provided, as a computer program product, in a non-transitory computer-readable recording medium such as a compact disc read only memory (CD-ROM), a flexible disk (FD), a compact disc recordable (CD-R), and a digital versatile disc (DVD), as an installable or executable file.

The computer programs that are executed by the printing apparatus 170, 170A, 170B, 169, 169A, or 169B, or the plasma processor 101 in the above-mentioned embodiment may be stored in a computer connected to a network such as the Internet and provided by being downloaded via the network. The computer programs that are executed by the printing apparatus 170, 170A, 170B, 169, 169A, or 169B, or the plasma processor 101 in the above-mentioned embodiment may be provided or distributed via a network such as the Internet.

The computer programs that are executed by the printing apparatus 170, 170A, 170B, 169, 169A, or 169B, or the plasma processor 101 in the above-mentioned embodiment may be embedded and provided in a ROM, for example.

The computer programs that are executed by the printing apparatus 170, 170A, 170B, 169, 169A, or 169B, or the plasma processor 101 in the above-mentioned embodiment have a module configuration including the above-mentioned units. As actual hardware, the CPU (processor) reads and executes the computer programs from the above-mentioned storage medium, so that the above-mentioned units are loaded on a main storage device to be generated on the main storage device.

The embodiments of the present invention provide an effect of reducing deterioration in image quality.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A printing apparatus configured to output a recording medium marked with an ink, the printing apparatus comprising:

a plasma processor that performs plasma processing on the recording medium;

a recording unit that discharges the ink and records dots onto the recording medium on which the plasma processing has been performed;

a heating unit that heats an ink discharge region of the recording medium; and a controller that controls both a plasma energy by the plasma processor and heating energy by the heating unit such that dots of the ink are recorded on the recording medium having at least one of a predetermined diameter, a predetermined shape, and a predetermined density distribution.

2. The printing apparatus according to claim 1, wherein: the heating unit heats the ink discharge region of the recording medium at a timing before the dots of the ink are recorded.

3. The printing apparatus according to claim 1, wherein: the controller controls at least one of the plasma energy by the plasma processor and the heating energy by the heating unit such that the dots of the ink are recorded on the recording medium in accordance with at least one of a printing mode used by the recording unit, a type of the recording medium, an amount of the ink that is discharged onto the recording medium, and a type of the ink that is discharged onto the recording medium.

4. The printing apparatus according to claim 1, further comprising:

a detector that detects a surface temperature of the recording medium at a time of recording of the dots of the ink, wherein the controller controls at least one of the plasma energy by the plasma processor and the heating energy by the heating unit such that the dots of the ink are formed on the recording medium based on the surface temperature.

5. The printing apparatus according to claim 4, wherein: the controller performs control to increase at least one of the plasma energy and the heating energy when the surface temperature is lower than a target temperature for the heating unit.

6. The printing apparatus according to claim 4, further comprising:

a head unit that supports the plasma processor, the recording unit, and the heating unit, a driving unit that moves the head unit in a direction of being close to or separated from the recording medium; and a sensor that detects a distance between the head unit and the recording medium, wherein the controller controls at least one of the plasma energy by the plasma processor and the heating energy by the heating unit so that the dots of the ink are formed on the recording medium based on at least one of the distance and the surface temperature.

7. The printing apparatus according to claim 1, wherein: the controller controls heating energy by the heating unit by controlling a heating temperature as a heat generation temperature by the heating unit and heating time by the heating unit.

8. The printing apparatus according to claim 1, wherein: the heating unit heats the ink discharge region of the recording medium by blowing out hot air toward the ink discharge region of the recording medium.

9. The printing apparatus according to claim 8, wherein: the controller controls heating energy by the heating unit by controlling a temperature of the hot air, a velocity of the hot air, and heating time.

10. A method operable by a printing apparatus that is configured to output a recording medium marked with an ink, the method comprising:

performing plasma processing on the recording medium utilizing a plasma processor of the printing apparatus;

discharging the ink onto the recording medium on which the plasma processing has been performed utilizing a recording unit of the printing apparatus;

heating an ink discharge region of the recording medium utilizing a heating unit of the printing apparatus; and controlling both a plasma energy by the plasma processor and heating energy by the heating unit such that predetermined dots of the ink are recorded on the recording medium having at least one of a predetermined diameter, a predetermined shape, and a predetermined density distribution utilizing a controller of the printing apparatus.

11. The printing apparatus according to claim 1, wherein: the heating unit heats the ink discharge region of the recording medium at a timing at which the dots of the ink are recorded.

12. The printing apparatus according to claim 1, wherein: the heating unit heats the ink discharge region of the recording medium at a timing after the dots of the ink are recorded.

13. The printing apparatus according to claim 1, wherein: the recording medium comprises paper.

14. The printing apparatus of claim 1, wherein:

the controller that controls both the plasma energy by the plasma processor and the heating energy by the heating unit such that the dots of the ink have the predetermined shape.

15. The printing apparatus of claim 1, wherein:

the controller that controls both the plasma energy by the plasma processor and the heating energy by the heating unit such that the dots of the ink have the predetermined density distribution.

* * * * *